US008750777B2

(12) United States Patent
Matsubara et al.

(10) Patent No.: US 8,750,777 B2
(45) Date of Patent: Jun. 10, 2014

(54) FIXING DEVICE AND IMAGE-FORMING APPARATUS INCLUDING THE SAME

(75) Inventors: Takashi Matsubara, Kanagawa (JP); Akira Sakamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 289 days.

(21) Appl. No.: 13/372,162

(22) Filed: Feb. 13, 2012

(65) Prior Publication Data

US 2013/0071160 A1 Mar. 21, 2013

(30) Foreign Application Priority Data

Sep. 16, 2011 (JP) ..... 2011-203297

(51) Int. Cl.
*G03G 15/20* (2006.01)

(52) U.S. Cl.
CPC ..... *G03G 15/2007* (2013.01); *G03G 15/2003* (2013.01); *G03G 15/20* (2013.01)
USPC ..... 399/336; 399/335; 399/337

(58) Field of Classification Search
CPC G03G 15/20; G03G 15/2003; G03G 15/2007
USPC ..... 399/335, 336, 337
See application file for complete search history.

(56) References Cited

U.S. PATENT DOCUMENTS 8,606,166 B2 * 12/2013 Maeda ..... 399/337

FOREIGN PATENT DOCUMENTS

| | | | |
|---|---|---|---|
| JP | 59-095573 | A | 6/1984 |
| JP | 60-107068 | A | 6/1985 |
| JP | 2000-305385 | A | 11/2000 |

* cited by examiner

*Primary Examiner* — David Gray
*Assistant Examiner* — Michael Harrison
(74) *Attorney, Agent, or Firm* — Sughrue Mion, PLLC

(57) ABSTRACT

A fixing device includes an irradiation unit, disposed opposite a recording medium, that includes laser light sources arranged in a direction crossing a movement direction of the recording medium and capable of emitting laser light with variable emission intensity and that irradiates a surface of the recording medium with the laser light emitted from the laser light sources in a substantially elongated irradiation region extending at a corresponding position in the arrangement direction of the laser light sources; an irradiation-width changing unit that changes the irradiation width of the irradiation region in a longitudinal direction thereof, with all the laser light sources of the irradiation unit turned on; and an irradiation-intensity adjusting unit that adjusts the irradiation intensity in the irradiation region having the irradiation width thereof changed by the irradiation-width changing unit to a predetermined required irradiation intensity.

18 Claims, 19 Drawing Sheets

| RECORDING MATERIAL / ITEM | WIDTH 1 | WIDTH 2 | WIDTH 3 | WIDTH 4 |
|---|---|---|---|---|
| HEIGHT | A | B | C | D |
| VARIABLE RESISTANCE | a | b | c | d |

(WIDTH 1 > WIDTH 2 > WIDTH 3 > WIDTH 4
A > B > C > D
a < b < c < d)

(W1 > W2
PW1 > PW2)

FIXING DEVICE AND IMAGE-FORMING APPARATUS INCLUDING THE SAME

CROSS-REFERENCE TO RELATED APPLICATIONS

This application is based on and claims priority under 35 USC 119 from Japanese Patent Application No. 2011-203297 filed Sep. 16, 2011.

BACKGROUND

(i) Technical Field

The present invention relates to fixing devices and image-forming apparatuses including fixing devices.

SUMMARY

According to an aspect of the invention, there is provided a fixing device including an irradiation unit that is disposed opposite a recording medium having an unfixed image of an image-forming material capable of being thermally fixed, that includes laser light sources arranged in a direction crossing a movement direction of the recording medium and capable of emitting laser light with variable emission intensity, and that irradiates a surface of the recording medium with the laser light emitted from the laser light sources in a substantially elongated irradiation region extending at a corresponding position in the arrangement direction of the laser light sources; an irradiation-width changing unit that changes the irradiation width of the irradiation region in a longitudinal direction thereof, with all the laser light sources of the irradiation unit turned on; and an irradiation-intensity adjusting unit that adjusts the irradiation intensity in the irradiation region having the irradiation width thereof changed by the irradiation-width changing unit to maintain a predetermined required irradiation intensity.

BRIEF DESCRIPTION OF THE DRAWINGS

Exemplary embodiment(s) of the present invention will be described in detail based on the following figures, wherein.

DETAILED DESCRIPTION

General Exemplary Embodiment

First, a fixing device according to a general exemplary embodiment of the present invention will be described.

Figure 1A:
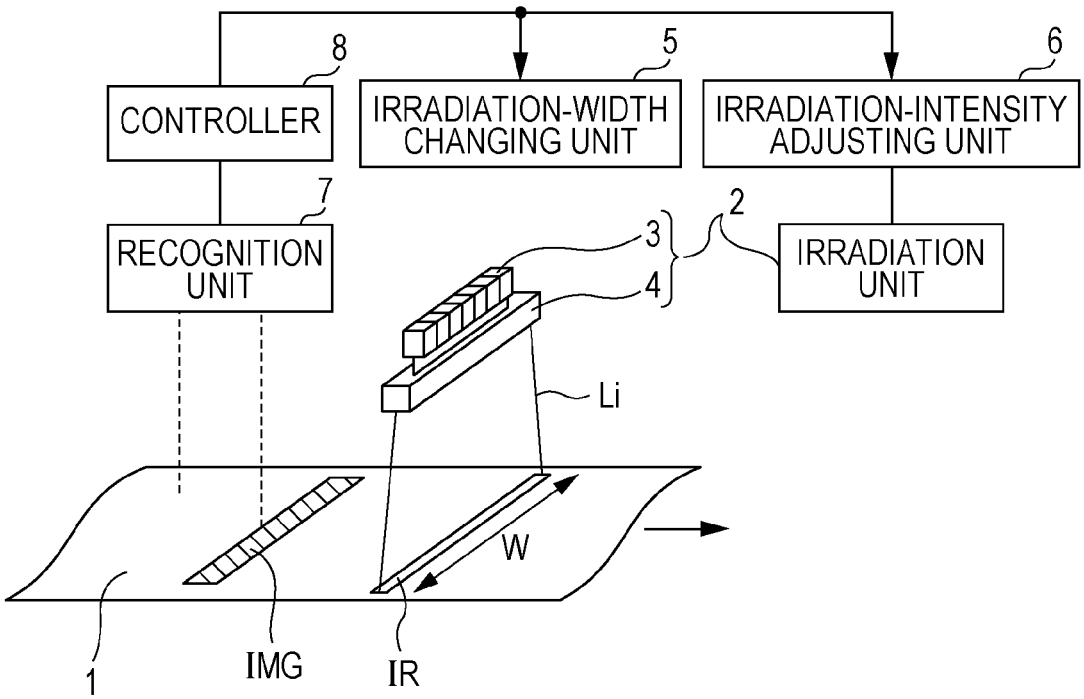
FIG. 1A is a schematic view showing a fixing device according to a general exemplary embodiment of the present invention.
Figure 1B:
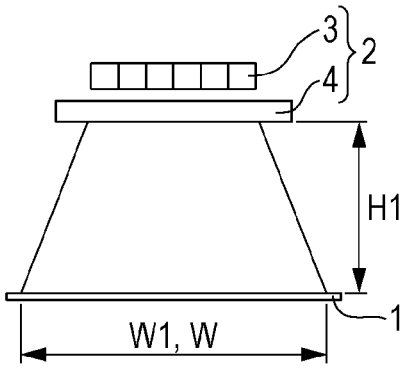
FIGS. 1B and 1C show two different irradiation widths of an irradiation region.
Figure 1C:
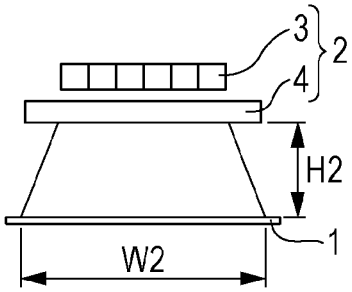

FIG. 1A is a schematic view showing a fixing device according to a general exemplary embodiment of the present invention. FIGS. 1B and 1C show two different irradiation widths of an irradiation region.

In FIG. 1A, the fixing device includes an irradiation unit 2, an irradiation-width changing unit 5, and an irradiation-intensity adjusting unit 6. The irradiation unit 2 is disposed opposite a recording medium 1 having an unfixed image IMG of an image-forming material capable of being thermally fixed. The irradiation unit 2 includes laser light sources 3 arranged in a direction crossing the movement direction of the recording medium 1 and capable of emitting laser light Li with variable emission intensity. The irradiation unit 2 irradiates the surface of the recording medium 1 with the laser light Li emitted from the laser light sources 3 directly or through an optical system 4 in an elongated or substantially elongated irradiation region IR extending at a corresponding position in the arrangement direction of the laser light sources 3. The irradiation-width changing unit 5 changes the irradiation width W of the irradiation region IR in the longitudinal direction thereof, with all the laser light sources 3 of the irradiation unit 2 turned on. The irradiation-intensity adjusting unit 6 adjusts the irradiation intensity in the irradiation region IR having the irradiation width W thereof changed by the irradiation-width changing unit 5 to maintain a predetermined required irradiation intensity.

To change the irradiation width W with all the laser light sources 3 turned on, for example, as shown in FIGS. 1B and 1C, the irradiation width W may be changed between a width W1 and a width W2 by changing the distance between the irradiation unit 2 and the recording medium 1 between a height H1 and a height H2.

The image-forming material may be any material, such as an electrophotographic toner, capable of being thermally fixed, although the material used is not limited thereto and may instead be, for example, a thermally fusible ink such as one used for inkjet printing. Accordingly, examples of unfixed images include electrophotographic images transferred onto recording media and images directly formed on recording media by, for example, inkjet printing. The recording medium 1 used is typically continuous paper (such as roll paper or fanfold paper) or flat paper (such as cut paper), although it may instead be a film medium other than paper.

The irradiation unit 2 may be composed only of the laser light sources 3 or may further include the optical system 4. The optical system 4 is, for example, an optical system that adjusts the optical path of the laser light Li emitted from the laser light sources 3, and various lenses may be used as the optical system 4. The fixing device may include any number of irradiation units 2; for example, it may include multiple irradiation units 2 arranged in the movement direction of the recording medium 1. The irradiation unit 2 may irradiate the recording medium 1 with the laser light Li at an angle to the surface of the recording medium 1, rather than perpendicularly.

The irradiation region IR may be formed in a straight line extending in the width direction of the recording medium 1, may be divided in parts, or may be formed at an angle to the width direction of the recording medium 1. The irradiation-width changing unit 5 may change the irradiation width W by moving at least part of the irradiation unit 2, by moving the recording medium 1, or by moving both.

The irradiation-intensity adjusting unit 6 may adjust the irradiation intensity in the irradiation region IR by adjusting the emission intensity of the laser light sources 3, by changing, for example, the distance between the laser light sources 3 and the irradiation region IR, or by changing both.

To extend the lives of the laser light sources 3, the irradiation-intensity adjusting unit 6 may adjust the emission intensity of the laser light sources 3 to facilitate the adjustment of the irradiation intensity in the irradiation region IR.

In this case, in view of easily setting the emission intensity of the laser light sources 3, the irradiation-intensity adjusting unit 6 may continuously or discontinuously change the emission intensity of the laser light sources 3 to a lower level if the irradiation-width changing unit 5 changes the irradiation width W of the irradiation region IR to a smaller width and may continuously or discontinuously change the emission intensity of the laser light sources 3 to a higher level if the irradiation-width changing unit 5 changes the irradiation width W of the irradiation region IR to a larger width. As used herein, the term "discontinuously change" includes stepwise changes. In addition, the terms "smaller irradiation width" and "larger irradiation width" refer to tendencies for the same recording medium 1 or unfixed image IMG. Accordingly, for example, the laser light Li requires a lower emission intensity at a smaller irradiation width W than at a larger irradiation width W to ensure the same irradiation intensity in the irradiation region IR for sufficient fixing.

In view of easily changing the irradiation width W in the irradiation region IR, the irradiation-width changing unit 5 may change the irradiation width W in the irradiation region IR by moving the entirety or part of the irradiation unit 2 in the irradiation direction of the laser light Li. For example, if the irradiation unit 2 is composed only of the laser light sources 3, the laser light sources 3 may be moved. If the irradiation unit 2 includes the laser light sources 3 and the optical system 4, it is possible to move the laser light sources 3 alone, to move the laser light sources 3 and part of the optical system 4, to move part of the optical system 4, or to move the entire irradiation unit (including the laser light sources 3 and the optical system 4).

In view of easily changing the irradiation width W while focusing the laser light Li in the irradiation region IR, the irradiation unit 2 may include the laser light sources 3 and the optical system 4 that guides the laser light Li to the irradiation region IR, the optical system 4 may include a focusing optical element fixedly disposed opposite the irradiation region IR to focus the laser light Li emitted from the laser light sources 3 in the irradiation region IR, and the irradiation-width changing unit 5 may move at least part of the optical system 4 other than the focusing optical element in the irradiation direction of the laser light Li. In this way, the laser light sources 3, which are commonly used ones, may be used together with the focusing optical element to sufficiently support focusing in the lateral direction of the irradiation region IR for varying distances between the laser light sources 3 and the focusing optical element.

In view of changing the irradiation width W by moving fewer optical elements in the case where the irradiation unit 2 includes a diverging optical element that causes the laser light Li to diverge in the arrangement direction of the laser light sources 3, the irradiation unit 2 may include the laser light sources 3 and the optical system 4 that guides the laser light Li to the irradiation region IR, the optical system 4 may include a diverging optical element that causes the laser light Li emitted from the laser light sources 3 to diverge in the arrangement direction of the laser light sources 3, and the irradiation-width changing unit 5 may move the laser light sources 3 and the diverging optical element in the irradiation direction of the laser light Li. This allows the laser light Li passing from the laser light sources 3 through the diverging optical element to have a constant angle of divergence. The irradiation width W of the laser light Li in the irradiation region IR varies depending on the position of the laser light sources 3 and the diverging optical element after movement.

In view of functionally separating the change in the irradiation width W in the irradiation region IR from the irradiation intensity distribution, the irradiation unit 2 may include the laser light sources 3 and the optical system 4 that guides the laser light Li to the irradiation region IR, the optical system 4 may include at least multiple optical elements arranged in the irradiation direction of the laser light Li, and the irradiation-width changing unit 5 may include a first moving mechanism that moves, of the optical elements, an optical element located closer to the laser light sources 3 in the irradiation direction of the laser light Li and a second moving mechanism that moves, of the optical elements, an optical element different from the optical element moved by the first moving mechanism in the irradiation direction of the laser light Li.

The first moving mechanism is used to form a uniform profile plane, where the laser light Li has a uniform irradiation profile in the arrangement direction of the laser light sources 3, at the middle position between the first moving mechanism and the irradiation region IR on the optical path of the laser light Li. The second moving mechanism, which is movable independently of the first moving mechanism, is used to focus the laser light Li having the uniform profile plane formed by the first moving mechanism in the irradiation region IR at the desired magnification.

As the above optical elements, for example, a combination of lenses or a single lens may be used, and they may have the function of, for example, causing the laser light Li to diverge, to be condensed, to be gathered, or to be focused. The optical element disposed closer to the laser light sources 3 may be an optical element extending along the entire array of the laser light sources 3 or, as long as its function is not impaired, for example, may be separately provided for each laser light source 3. Typical examples of such optical elements include cylindrical lenses.

Alternatively, the irradiation unit 2 may be configured as follows. That is, the irradiation unit may include at least laser light sources 3 having the light emission property of emitting laser light Li diverging in the arrangement direction of the laser light sources 3, and the irradiation-width changing unit 5 may move at least the laser light sources 3 in the irradiation direction of the laser light Li. In this case, the irradiation unit 2 may be composed of the laser light sources 3 or of the laser light sources 3 and the optical system 4, and the laser light sources 3 may be moved alone or together with the optical system 4.

In view of stabilizing the recording medium 1 while it is moved, the fixing device may further include an opposing member that is disposed opposite a position corresponding to at least the irradiation region IR on the back surface of the recording medium 1 and that moves that position in the irradiation direction of the laser light Li, and the irradiation-width changing unit 5 may change the irradiation width W of the irradiation region IR by moving the opposing member. The opposing member may have any shape. For example, the opposing member may be a plate member, or may be a belt member that moves in the movement direction of the recording medium 1.

In view of eliminating the need for adjustment of the emission intensity of the laser light sources 3, the irradiation-intensity adjusting unit 6 may adjust the distance between the laser light sources 3 and the irradiation region IR. In this case, the irradiation-intensity adjusting unit 6 may change the distance between the irradiation unit 2 and the recording medium 1 by moving the irradiation unit 2, by moving the recording medium 1, or by moving both the irradiation unit 2 and the recording medium 1. Although the lives of the laser light sources 3 are not expected to be prolonged in this case, the long-term uniformity of the irradiation intensity in the irradiation region IR is improved because the laser light sources 3 are equally driven.

In view of setting a more appropriate irradiation width W to the irradiation region IR, the fixing device may further include a recognition unit 7 that recognizes at least one of the width of the recording medium 1 and the width of the image-forming region on the recording medium 1 in the width direction, which crosses the movement direction of the recording medium 1, and a controller 8 that controls the irradiation-width changing unit 5 and the irradiation-intensity adjusting unit 6 on the basis of the result of recognition by the recognition unit 7 to maintain the required irradiation intensity in the irradiation region IR corresponding to the width of the recording medium 1 or the image-forming region. The recognition unit 7 may determine the width of the recording medium 1 by detecting it with, for example, a sensor or may recognize it from, for example, information input via a control panel. The width of the image-forming region may be recognized from image information or may be determined by detecting it with, for example, a line sensor.

In view of providing more practical electrical connections to the laser light sources 3, all or groups of the laser light sources 3 may be series-connected such that the current supplied to the laser light sources 3 is at or below a predetermined level. For such series connection, the current may be low if all the laser light sources 3 can be series-connected; however, they need to be partially parallel-connected if the voltage applied is excessively high. Thus, the laser light sources 3 may be series-connected within a predetermined current range.

If the fixing device is applied to an image-forming apparatus, the image-forming apparatus may include a transportation unit that transports the recording medium 1, an image-forming unit that forms an image on the recording medium 1 transported by the transportation unit, and the fixing device described above as a fixing device that fixes the image formed on the recording medium 1 by the image-forming unit.

If the recording medium 1 is, for example, continuous paper, the transportation unit may be a transportation device disposed at a position other than the fixing device to transport the recording medium 1. If the recording medium 1 has, for example, perforations, the transportation unit may have a feed mechanism. If the recording medium 1 is flat paper, the transportation unit may transport the recording medium 1 by holding the back surface thereof. If the unfixed image IMG does not extend to the sides of the recording medium 1 in the width direction, the transportation unit may transport the recording medium 1 by holding the sides.

The present invention will now be illustrated in greater detail by the exemplary embodiments shown in the drawings.

First Exemplary Embodiment

Figure 2:
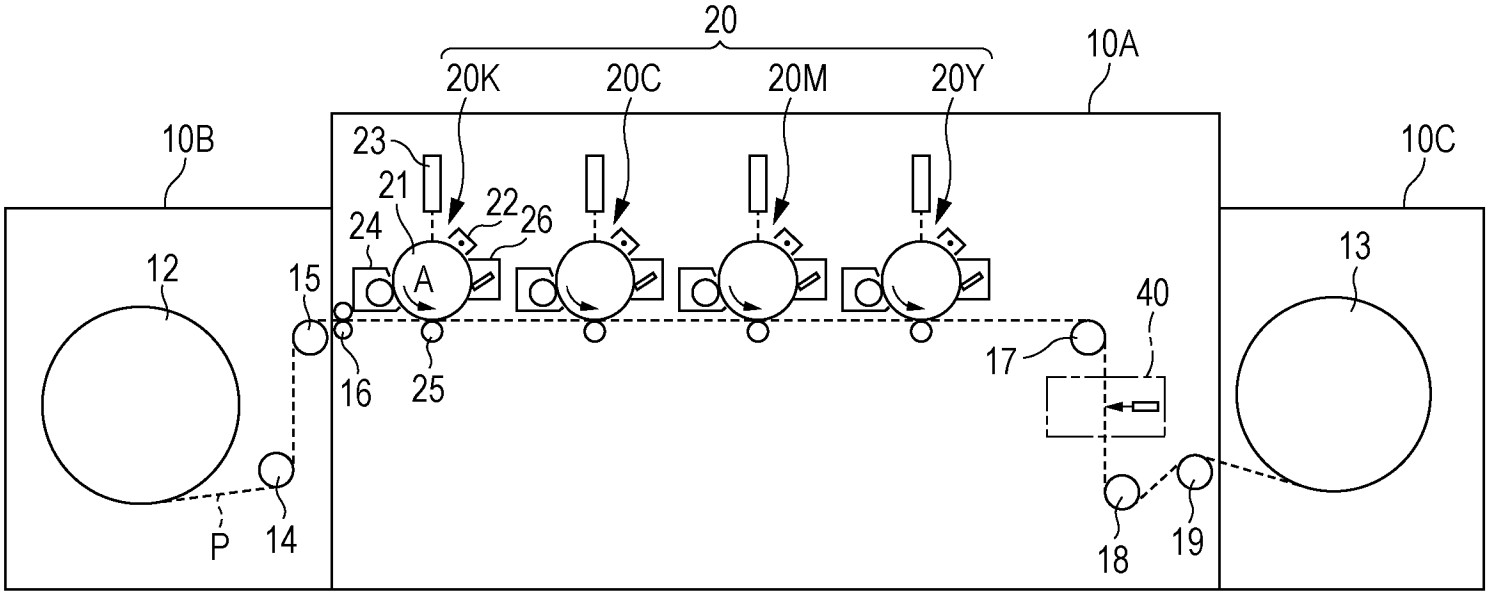
FIG. 2 is a schematic view showing the overall structure of an image-forming apparatus according to a first exemplary embodiment.

FIG. 2 is a schematic view showing the overall structure of an image-forming apparatus according to a first exemplary embodiment of the present invention, where the fixing device according to the general exemplary embodiment described above is applied to the image-forming apparatus.

The image-forming apparatus according to this exemplary embodiment, which is configured for use with a continuous recording medium P, includes an image-forming apparatus body 10A that forms an image on the recording medium P, a supply device 10B that supplies the recording medium P across both sides of the image-forming apparatus body 10A, and a collection device 10C that collects the recording medium P having the image formed thereon. The recording medium P used may be, for example, rolled or folded; in this exemplary embodiment, the recording medium P is rolled.

The image-forming apparatus body 10A according to this exemplary embodiment, which has, for example, an electrophotographic system, includes image-forming units 20 that form toner images of different colors on the recording medium P using, for example, four toners (specifically, a yellow image-forming unit 20Y, a magenta image-forming unit 20M, a cyan image-forming unit 20C, and a black image-forming unit 20K); a fixing device 40 that fixes toner images superimposed on the recording medium P by the image-forming units 20; and rollers 16 to 19.

The roller 16 is a registration roller that adjusts the position of the recording medium P before it is guided to the image-forming units 20. The roller 17 is a tension roller that guides the recording medium P to the fixing device 40. The rollers 18 and 19 are tension-applying rollers that apply appropriate tension to the recording medium P as it is transported to the collection device 10C after fixing.

The image-forming units 20 have substantially the same structure except for the toner used; as a typical example, the black image-forming unit 20K is described here. The black image-forming unit 20K includes a cylindrical photoreceptor drum 21 that has a photosensitive layer (not shown) and that rotates in the direction indicated by arrow A. The photoreceptor drum 21 is surrounded by various devices, including a charging device 22 that charges the photosensitive layer on the photoreceptor drum 21 to a predetermined potential, an exposure device 23 that selectively irradiates the photosensitive layer charged by the charging device 22 with, for example, laser light to form an electrostatic latent image on the photoreceptor drum 21, a developing device 24 that develops the electrostatic latent image formed by the exposure device 23 with a toner to form a visible image, a transfer device 25 that transfers the toner image from the photoreceptor drum 21 onto the recording medium P, and a cleaning device 26 that removes residual toner from the photoreceptor drum 21 after transfer. The arrangement of the toner colors of the image-forming units 20 is not limited to that shown; it should be understood that other arrangements are permitted.

The supply device 10B includes a supply roller 12 around which the recording medium P is wound in a roll and tension-applying rollers 14 and 15 that transport the recording medium P while applying tension to supply the recording medium P to the image-forming apparatus body 10A. The collection device 10C includes a takeup roller 13 around which the recording medium P is wound.

In the thus-configured image-forming apparatus, toner images of different colors are transferred and superimposed onto the recording medium P supplied from the supply device 10B by the image-forming units 20 of the image-forming apparatus body 10A. After the superimposed unfixed toner images are fixed by the fixing device 40, the recording medium P is wound and collected by the collection device 10C.

Next, the fixing device 40 of the above image-forming apparatus will be described with reference to FIGS. 3A and 3B.

Figure 3B:
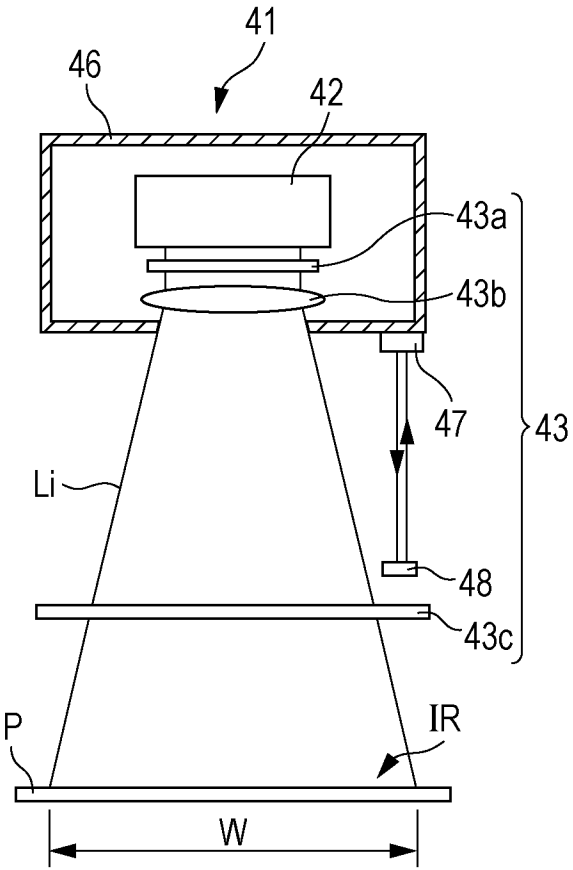
FIGS. 3A and 3B are schematic views of a fixing device according to the first exemplary embodiment.
Figure 3A:
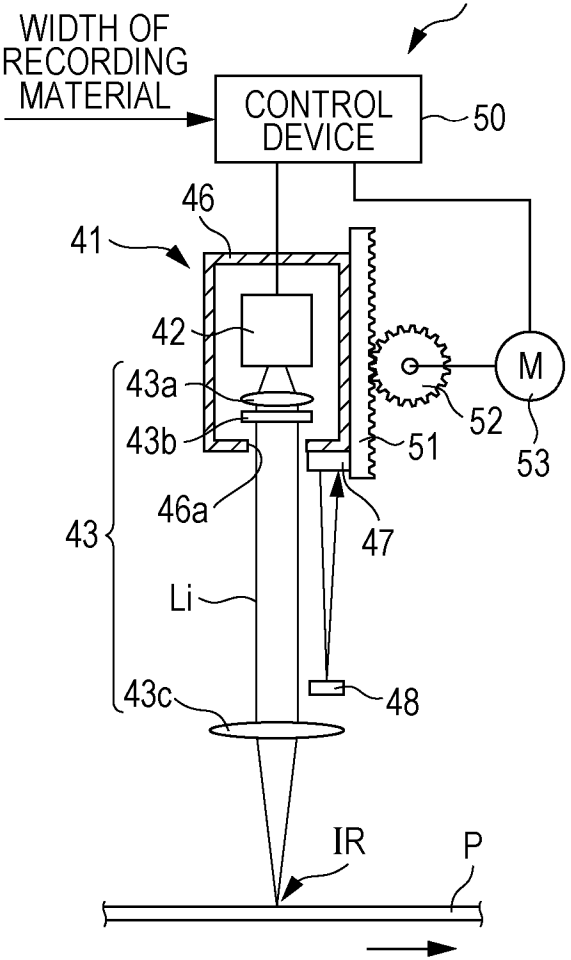

FIG. 3A is a schematic view of the fixing device 40 as viewed in the width direction of the recording medium P, which crosses the transportation direction thereof. FIG. 3B is a schematic view of the fixing device 40 as viewed in the transportation direction of the recording medium P. The fixing device 40 according to this exemplary embodiment is configured such that the laser light Li is incident on the surface of the recording medium P substantially perpendicularly.

The fixing device 40 includes an irradiation device 41, as an irradiation unit, that irradiates the surface of the recording medium P with laser light Li emitted from an LD array 42, as laser light sources, in an elongated or substantially elongated irradiation region IR extending at a corresponding position. The irradiation device 41 used in this exemplary embodiment includes the LD array 42 and, as an optical system, various optical elements 43 (43*a* to 43*c*). The LD array 42 is arranged in the width direction of the recording medium P, which crosses the transportation direction of the recording medium P, and is capable of emitting laser light Li with variable emission intensity. The optical elements 43 (43*a* to 43*c*) are disposed between the LD array 42 and the recording medium P to adjust the optical path of the laser light Li emitted from the LD array 42, thereby guiding the laser light Li to the irradiation region IR.

The optical elements 43 used in this exemplary embodiment include a lens 43*a*, as a condensing optical element, that condenses the laser light Li emitted from the LD array 42 into substantially parallel light with the required beam width in a direction crossing the arrangement direction of the LD array 42; a lens 43*b*, as a diverging optical element, that causes the laser light Li passing through the lens 43*b* to diverge in the arrangement direction of the LD array 42; and a lens 43*c*, as a focusing optical element, that focuses the laser light Li passing through the lens 43*b* in the irradiation region IR in the lateral direction thereof. While the lens 43*a* is disposed closer to the LD array 42 than is the lens 43*b* in this exemplary embodiment, the lens 43*b* may be disposed closer to the LD array 42.

The optical elements 43 used are as follows. The lens 43*a* is, for example, a cylindrical lens that condenses the laser light Li emitted from the LD array 42 into parallel light in the transportation direction of the recording medium P. The lens 43*b* is, for example, a cylindrical lens that causes the laser light Li emitted from the LD array 42 and passing through the lens 43*a* to diverge in the width direction of the recording medium P. The lens 43*c* is, for example, a cylindrical lens that focuses the laser light Li to the length of the irradiation region IR on the recording medium P in the transportation direction of the recording medium P (in the lateral direction of the irradiation region IR). Thus, in this exemplary embodiment, the laser light Li passing through the lenses 43 (specifically, the lenses 43*a* to 43*c*) forms the irradiation region IR, which has the irradiation width W in the longitudinal direction, on the recording medium P. While cylindrical lenses, which have refractive power in one of the longitudinal direction (irradiation width W direction) and lateral direction of the irradiation region IR and which have no refractive power in the other direction, are used in this exemplary embodiment, any element having such a function may be applied.

In this exemplary embodiment, the LD array 42 and the lenses 43*a* and 43*b* are fixedly disposed in an outer case 46 as a single unit by any method (not shown). The lens 43*c* is fixedly disposed at a predetermined position. The laser light Li is emitted from an opening 46*a* of the outer case 46.

Figure 4A:
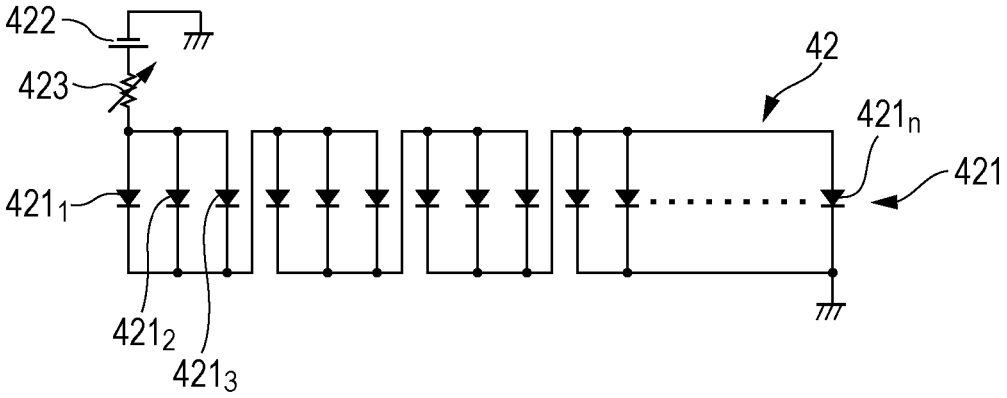
FIG. 4A is a schematic view showing a laser diode (LD) array used in the first exemplary embodiment.

As shown in the schematic view of FIG. 4A, the LD array 42 used in this exemplary embodiment is an array of high-output semiconductor LDs 421 in which groups of an appropriate number of (in the example illustrated, three) parallel-connected LDs 421 are series-connected. In this exemplary embodiment, a power supply 422 that supplies a current to all LDs 421 and a variable resistor 423 capable of changing the current supplied by the power supply 422 are also provided.

While the current is changed with a variable resistor in this exemplary embodiment, it may be changed by any known method, for example, by providing a constant-current circuit to change the set current, or by connecting a resistor in series to the LDs 421 to change the voltages applied to the LDs 421 and the resistor.

The LDs 421 (specifically, the LDs $\mathbf{421}_1$ to $\mathbf{421}_n$) have substantially the same electrical characteristics and therefore have substantially the same emission intensity irrespective of whether they are parallel-connected or series-connected. In this exemplary embodiment, additionally, because groups of an appropriate number of parallel-connected LDs 421 are series-connected, the total current supplied to the LDs 421 may be lower, and the wires may be thinner than those used for connecting all the LDs 421 in parallel, as in the comparative examples described later.

Figure 4B:
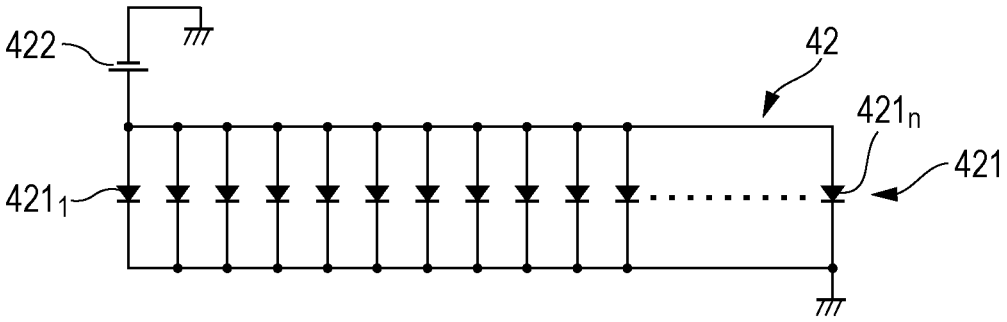
FIGS. 4B and 4C are schematic views showing LD arrays of comparative examples.
Figure 4C:
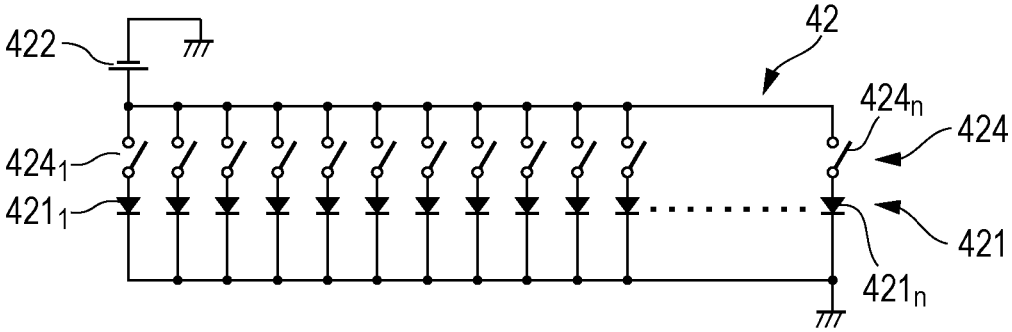

In contrast, FIG. 4B shows a comparative example in which all LDs 421 are parallel-connected. In this case, a large current is required because the current supplied by the power supply 422 is equal to the sum of the currents flowing through the individual LDs 421. This also requires thick wiring cables for the large current to flow through. FIG. 4C shows another comparative example in which switching devices 424 are provided for the individual LDs 421. In this case, the switching devices 424 are driven to energize the corresponding LDs 421. To change the irradiation width (not shown), for example, the switching devices 424 closer to both ends are turned off, with the switching devices 424 closer to the center turned on, to attain the irradiation width corresponding to the on-state switching devices 424.

In this exemplary embodiment, as shown in FIG. 4A, the LD array 42 has the variable resistor 423, and the irradiation width is changed with all LDs 421 turned on, as described later.

As shown in FIGS. 3A and 3B, additionally, the outer case 46 used in this exemplary embodiment has a proximity sensor 47 fixedly disposed on the bottom surface thereof, and a reflector 48 for reflecting light from the proximity sensor 47 is disposed closer to the recording medium P than is the proximity sensor 47. The reflector 48 is located at a predetermined height from the recording medium P. The outer case 46 also has a rack 51 having teeth arranged in the direction from top to bottom in FIGS. 3A and 3B, a pinion 52, for moving the rack 51, rotatably disposed at a position corresponding to the rack 51, and a motor 53 for rotating the pinion 52.

In this exemplary embodiment, a control device 50 is provided that controls the driving of the motor 53 and the emission intensity of the LD array 42. The control flow of the control device 50 in this exemplary embodiment will now be described with reference to the flowchart shown in FIG. 5A.

First, the width of the recording medium P used is input, for example, via a control panel (not shown) (Step S1). The control device 50 then drives the motor 53 to attain the irradiation width W matching the input width of the recording medium P on the basis of a stored correspondence table (Step S2). As the motor 53 is driven, the outer case 46 is moved upward or downward by the action of the pinion 52 and the rack 51. The motor 53 may be driven until the distance between the proximity sensor 47 and the reflector 48 reaches a predetermined value (height). Next, the resistance of the variable resistor 423 (see FIG. 4A) of the LD array 42 is adjusted to attain the emission intensity matching the input width of the recording medium P on the basis of a stored correspondence table (Step S3). It should be understood that the irradiation intensity in the irradiation region IR is optimized at that emission intensity.

Figures 5A, 5B:
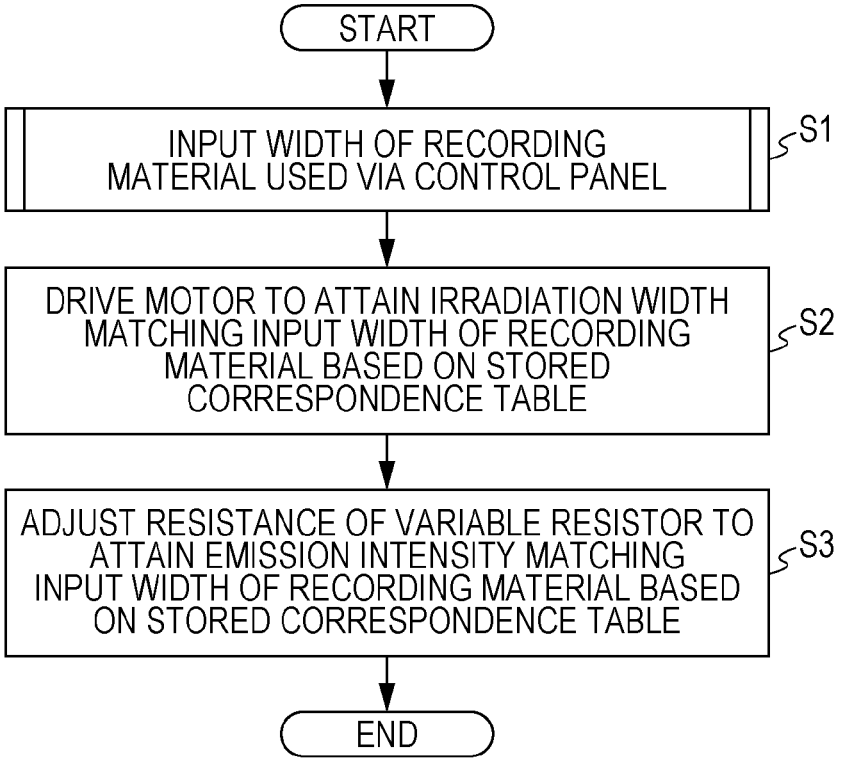
FIG. 5A is a flowchart showing the control flow of a control device.
FIG. 5B is an example of a correspondence table.

By the above operation, in this exemplary embodiment, the LD array 42 and the two lenses 43*a* and 43*b* are moved together with the outer case 46 to attain the irradiation width W and irradiation intensity matching the recording medium P. FIG. 5B shows an example of a correspondence table in which the width of the recording medium P used falls into widths 1 to 4, each assigned a particular height (corresponding to the distance between the proximity sensor 47 and the reflector 48 in this exemplary embodiment) and a particular resistance, where width 1>width 2>width 3>width 4, A>B>C>D, and a<b<c<d.

Figure 6B:
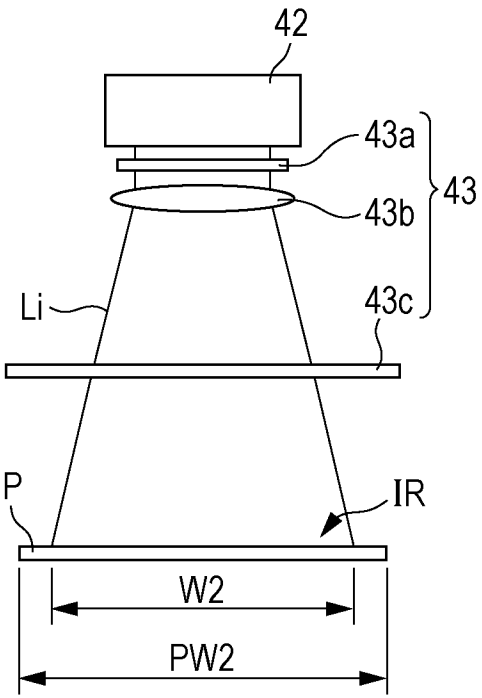
FIGS. 6A and 6B are schematic views showing different irradiation widths in the first exemplary embodiment.
Figure 6A:
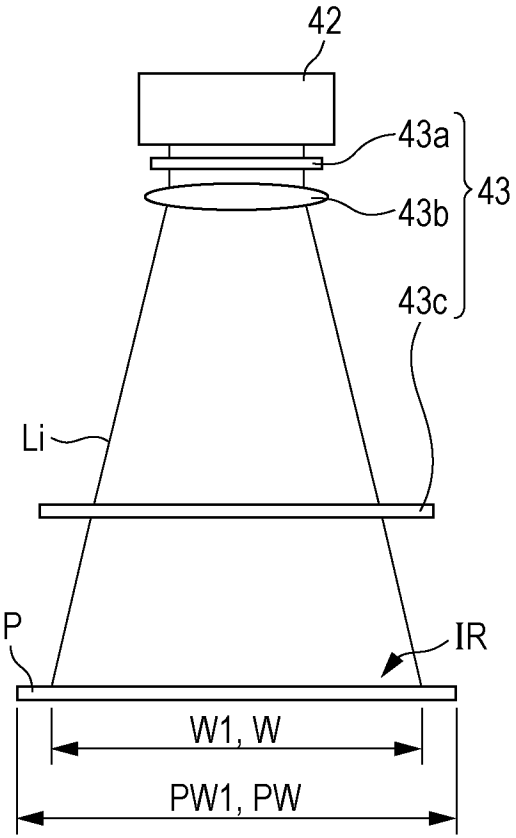

FIGS. 6A and 6B show how the irradiation width W is changed by such control. In FIG. 6A, the recording medium P has a larger width PW1 (PW). In this case, the recording medium P and the LD array 42 are separated by a larger distance, and the irradiation width W1 on the recording medium P is larger. In FIG. 6B, in contrast, the recording medium P has a smaller width PW2. In this case, the recording medium P and the LD array 42 are separated by a smaller distance, and the irradiation width W2 on the recording medium P is smaller than in FIG. 6A.

If the emission intensity of the LD array 42 for a larger irradiation width W on the recording medium P is applied as it is to a smaller irradiation width W, the irradiation intensity per unit area in the irradiation region IR on the recording medium P becomes correspondingly higher, thus possibly overheating an unfixed image. In this exemplary embodiment, because the emission intensity of the LD array 42 is changed depending on the irradiation width W, the irradiation intensity on the recording medium P can be adjusted to the required level for varying irradiation widths W, thus easily avoiding a problem in the fixing of an unfixed image.

In general, the temperature of the LD array 42 rises with increasing emission intensity of the LD array 42. It is generally known that degradation of parts due to temperature rise follows the Arrhenius equation. That is, reducing the emission intensity inhibits the temperature rise of the LD array 42 and therefore retards its degradation and extends its life. In this exemplary embodiment, the emission intensity is made lower for a smaller irradiation width W than for a larger irradiation width W, and the life of the LD array 42 therefore becomes correspondingly longer.

In this exemplary embodiment, additionally, the LDs 421 of the LD array 42 are equally driven because the irradiation width W is changed with all LDs 421 turned on, thus ensuring a uniform irradiation intensity distribution in the irradiation region IR over an extended period of time.

Next, a known configuration for changing the irradiation width W will be described as a comparative example.

Figure 7B:
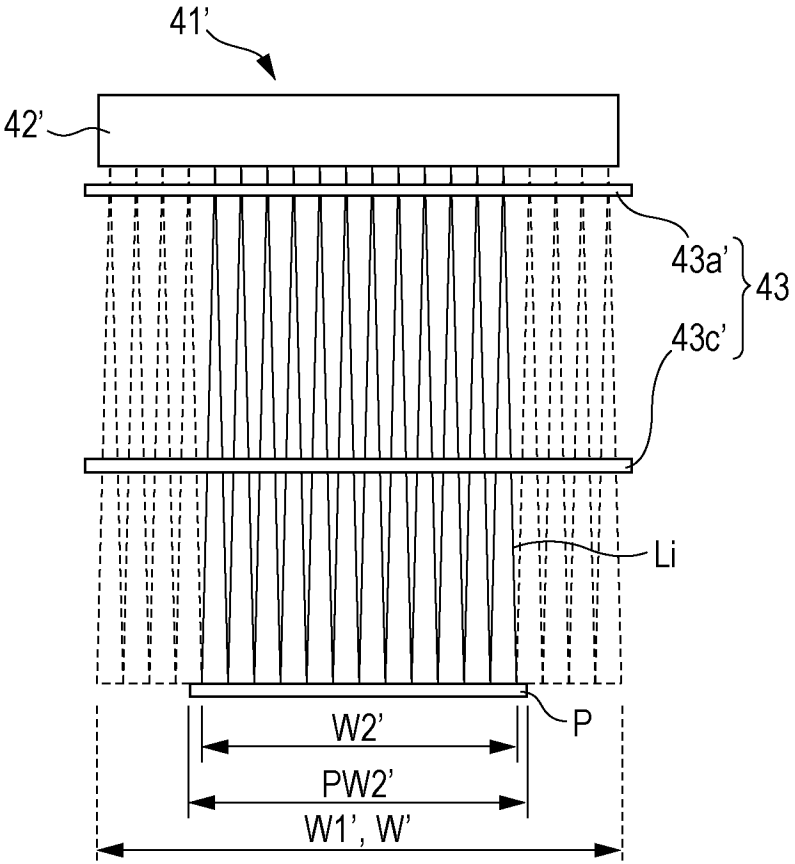
FIGS. 7A and 7B are schematic views showing a fixing device of a comparative example.
Figure 7A:
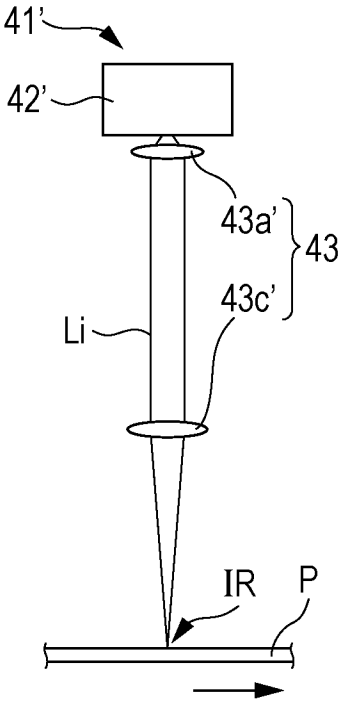

FIGS. 7A and 7B are schematic views showing part of a fixing device of a comparative example in which an irradiation device 41' includes an LD array 42' and two lenses 43*a*' and 43*c*' as the optical elements 43. Of the optical elements 43, the lens 43*a*' is a condensing optical element that condenses the laser light Li into substantially parallel light with the required beam width in a direction crossing the arrangement direction of the LD array 42'. The lens 43*c*' is a focusing optical element that focuses the laser light Li in the irradiation region IR in the lateral direction thereof.

In this configuration, in which the LD array 42' has no moving mechanism, the distance between the LD array 42' and the recording medium P remains the same, and the overall irradiation width W1' (W'), with the entire LD array 42' turned on, is fixed. To set a smaller irradiation width W2' for a recording medium P having a width PW2', the LDs of the LD array 42' located outside the irradiation width W2' (those closer to both ends) need to be turned off.

To change the irradiation width W' depending on the width of the recording medium P, in this configuration, the LD array 42 needs to be turned on and off for each LD. Accordingly, the on-time of the LDs varies, thus resulting in a difference in the degree of degradation over time between LDs having a longer on-time and LDs having a shorter on-time. In general, the LDs located closer to the center of the LD array 42' have a longer on-time and therefore a higher degree of degradation than those located closer to the ends. After extended use of the LD array 42', the irradiation intensity per unit area of the laser light Li on the recording medium P varies between the center and the ends. This may result in varying fixing conditions for an unfixed image on the recording medium P in the irradiation region IR.

In this exemplary embodiment, in which the irradiation width W is changed with the entire LD array 42 turned on, the LDs of the LD array 42 have the same on-time and are equally driven. Accordingly, the irradiation intensity per unit area remains uniform in the irradiation region IR. This ensures a stable fixing condition for an extended period of time.

While the height of the outer case 46 is determined using the proximity sensor 47 and the reflector 48 in this exemplary embodiment, for example, the outer case 46 may be positioned at different levels defined in advance. In addition, while the reflector 48 is disposed closer to the LD array 42 than is the recording medium P, it may be disposed on either side.

While the optical elements 43 used are the lenses 43*a* to 43*c*, they may be any combination of optical elements that allows the laser light Li to be focused in the irradiation region IR and to diverge to the irradiation width W on the recording medium P. In addition, while the LD array 42 and the lenses 43*a* and 43*b* are moved together in this exemplary embodiment, for example, the lens 43*b* may be moved alone, with the LD array 42 and the lens 43*a* held at predetermined positions.

While the outer case 46 is moved by the rack 51 and the pinion 52, for example, it may be moved by a slider that reciprocates along a guide rail. In addition, while the laser light Li is incident on the recording medium P substantially perpendicularly in this exemplary embodiment, it may be incident at an angle to the recording medium P. In addition, multiple LD arrays 42 may be arranged in the transportation direction of the recording medium P.

While the irradiation region IR on the recording medium P extends in the width direction of the recording medium P, which crosses the transportation direction of the recording medium P, in this exemplary embodiment, it may extend in a direction skewed to the width direction of the recording medium P. This decreases the effective area coverage in the irradiation region IR for an unfixed image, such as a ruled line, extending in the width direction of the recording medium P, thus allowing it to be more stably fixed.

While the width of the recording medium P is input via a control panel in this exemplary embodiment, the irradiation width W may be determined on the basis of information acquired by detecting the width of the recording medium P used with, for example, a line sensor. It is also possible to determine the width of an unfixed image, rather than the width of the recording medium P, from image information to set an irradiation width W matching the determined width of the unfixed image, or to detect the actual width of the image-forming region with, for example, a line sensor to set an irradiation width W matching the detected width of the image-forming region. In addition, the irradiation width W may be larger than the width matching the actual width of the recording medium P or the image-forming region. For example, the irradiation width W may be set to 49 cm for a recording medium P having an actual width of 50 cm, or may be set to 46 cm for an image-forming region having a width of 45 cm.

Second Exemplary Embodiment

Figure 8B:
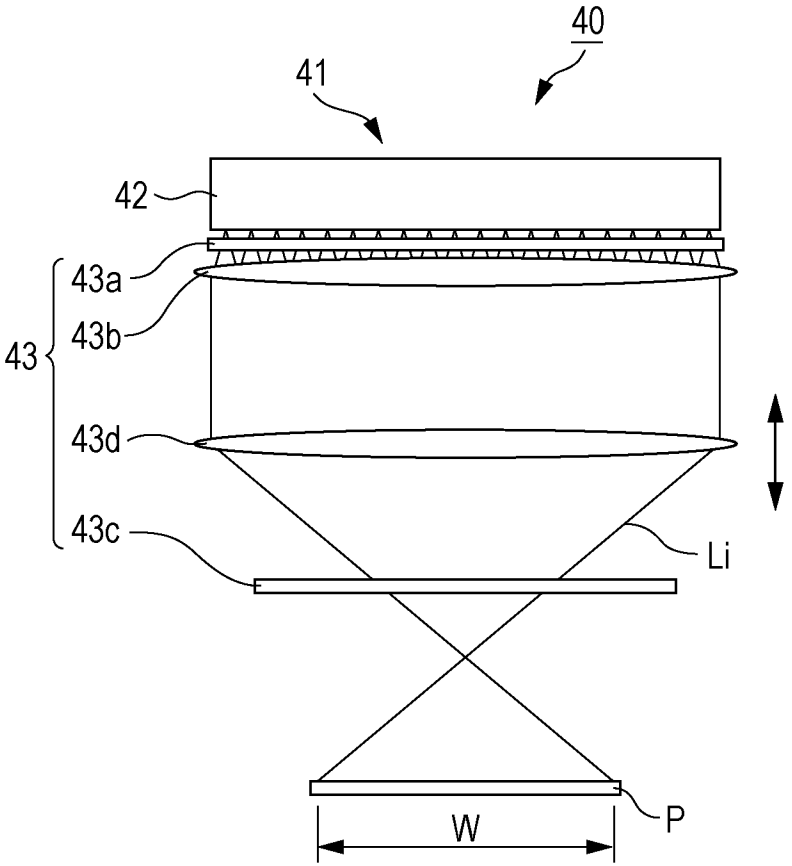
FIGS. 8A and 8B are schematic views showing a fixing device according to a second exemplary embodiment.
Figure 8A:
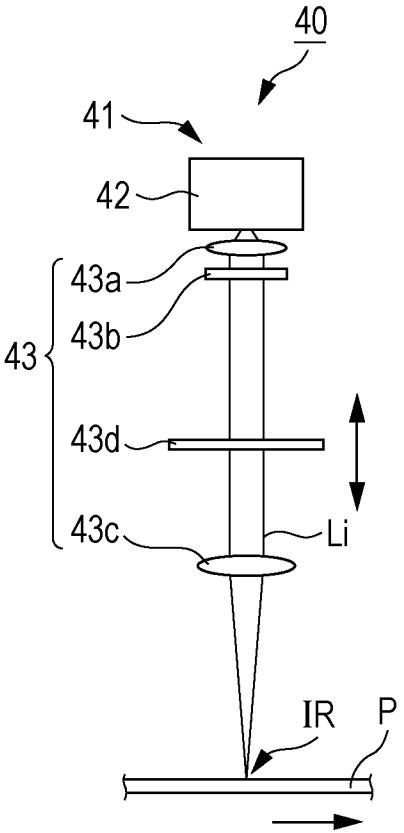

FIGS. 8A and 8B schematically show a fixing device 40 according to a second exemplary embodiment. FIG. 8A is a schematic view of the fixing device 40 as viewed in the width direction of the recording medium P, which crosses the transportation direction thereof. FIG. 8B is a schematic view of the fixing device 40 as viewed in the transportation direction of the recording medium P. Unlike the irradiation device 41 of the fixing device 40 according to the first exemplary embodiment, the fixing device 40 according to this exemplary embodiment includes four lenses 43*a* to 43*d*, as the optical elements 43, as well as the LD array 42. The fixing device 40 is configured such that the lens 43*d* is movable, with the LD array 42 fixed. The same elements as in the first exemplary embodiment are denoted by the same reference numerals, and a detailed description thereof is omitted here.

The optical elements 43 used in this exemplary embodiment are as follows. The lens 43*a* is a condensing optical element that condenses the laser light Li into substantially parallel light with the required beam width in a direction crossing the arrangement direction of the LD array 42. The lens 43*b* gathers the laser light Li with the required beam width in the arrangement direction of the LD array 42. The lens 43*d* is a focusing optical element that focuses the laser light Li passing through the lens 43*b* at the magnification corresponding to the irradiation width W of the irradiation region IR. The lens 43*c* is a focusing optical element that focuses the laser light Li passing through the lens 43*d* in the irradiation region IR in the lateral direction thereof.

Specifically, the optical elements 43 used may be as follows. The lens 43*a* is a lens that gathers the laser light Li emitted from the LD array 42 into parallel light in the transportation direction of the recording medium P. The lens 43*b* is a lens that slightly gathers the laser light Li passing through the lens 43*a* into parallel light in the width direction of the recording medium P. The lens 43*d* is a lens that focuses the laser light Li passing through the lens 43*b* at a position before the recording medium P to magnify the laser light Li to the irradiation width W on the recording medium P. The lens 43*c* is a lens that focuses the laser light Li passing through the lens 43*d* to the length of the irradiation region IR on the recording medium P in the transportation direction of the recording medium P (in the lateral direction of the irradiation region IR).

In this exemplary embodiment, of the four lenses 43*a* to 43*d*, only the lens 43*d* is movable upward and downward in FIGS. 8A and 8B by a moving mechanism (not shown). The moving mechanism used may be any mechanism that can move the lens 43*d*, and a known mechanism may be used.

Figure 9B:
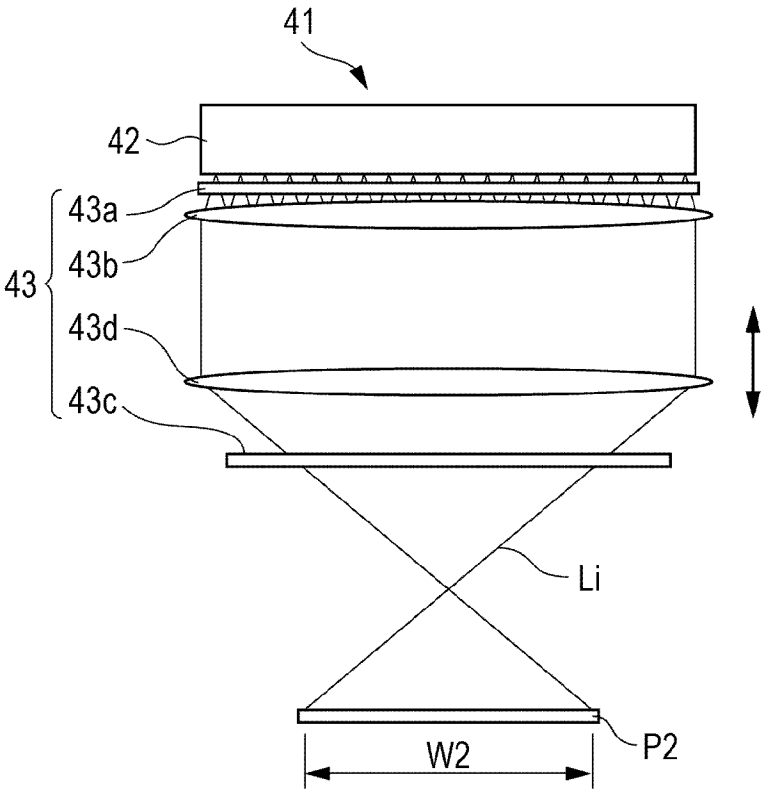
FIGS. 9A and 9B are schematic views showing different irradiation widths in the second exemplary embodiment.
Figure 9A:
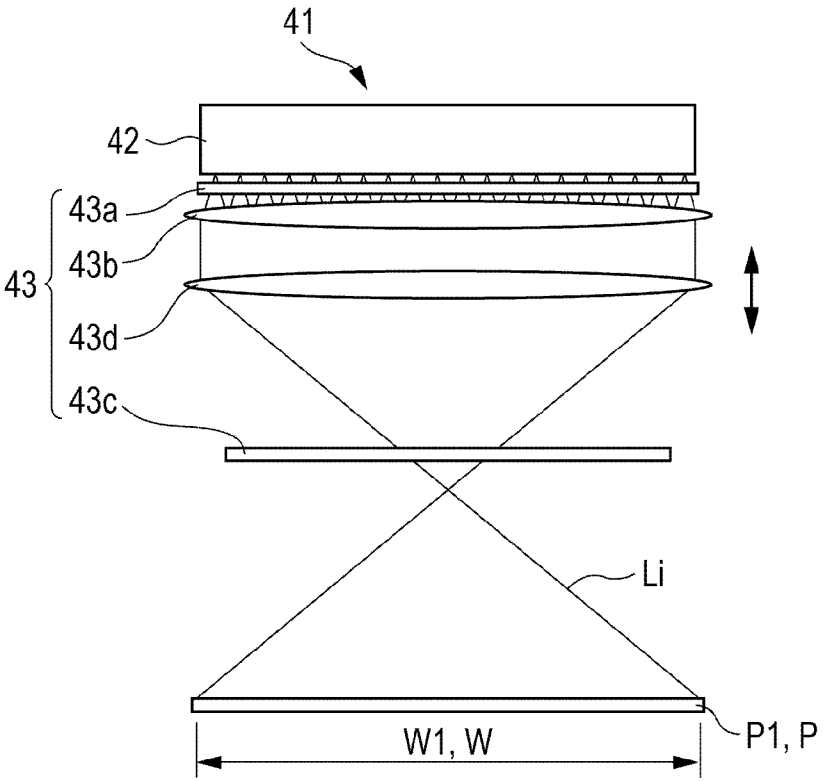

In this configuration, as the lens 43*d* is moved, the irradiation width W on the recording medium P changes as shown in FIGS. 9A and 9B. FIG. 9A shows the state where the lens 43*d* is moved closer to the LD array 42, where the laser light Li has a larger irradiation width W1 on a recording medium P1. FIG. 9B shows the state where the lens 43*d* is moved closer to a narrower recording medium P2, where the laser light Li has a correspondingly smaller irradiation width W2 on the recording medium P2.

In this exemplary embodiment, the emission intensity of the LD array 42 is also changed so that the emission intensity is lower in FIG. 9B than in FIG. 9A. This improves the uniformity of the irradiation intensity per unit area in the irradiation region IR and the life of the LD array 42 as compared to the case where the emission intensity is not changed. Although this configuration requires certain distances between the lens 43*d* and the lenses 43*b* and 43*c*, the lens 43*d* may be simply moved to change the irradiation width W in the irradiation region IR over a wide range.

Third Exemplary Embodiment

Figure 10B:
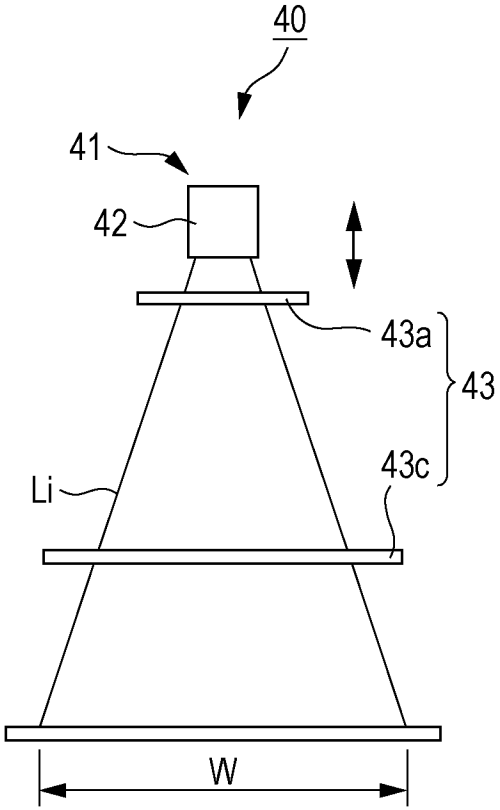
FIGS. 10A and 10B are schematic views showing a fixing device according to a third exemplary embodiment.
Figure 10A:
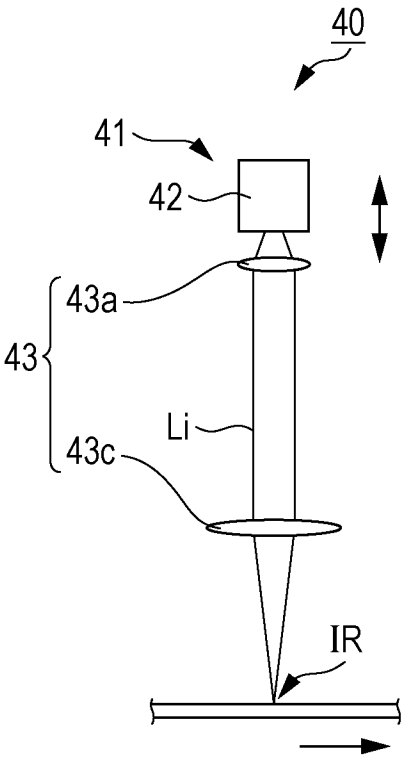

FIGS. 10A and 10B schematically show a fixing device 40 according to a third exemplary embodiment. FIG. 10A is a schematic view of the fixing device 40 as viewed in the width direction of the recording medium P, which crosses the transportation direction thereof. FIG. 10B is a schematic view of the fixing device 40 as viewed in the transportation direction of the recording medium P. The fixing device 40 according to this exemplary embodiment is similar to that according to the first exemplary embodiment, although they differ in the type of LD array 42. The same elements as in the first exemplary embodiment are denoted by the same reference numerals, and a detailed description thereof is omitted here.

The LD array 42 used in this exemplary embodiment includes LDs having the light emission property of emitting laser light Li diverging in the arrangement direction of the LD array 42. The LD array 42 is disposed such that the direction in which the laser light Li diverges at a larger angle is aligned to the direction of the irradiation width W of the irradiation region IR. The optical elements 43 include a lens 43*a*, as a condensing optical element, that condenses the laser light Li into substantially parallel light with the required beam width in a direction crossing the arrangement direction of the LD array 42; and a lens 43*c*, as a focusing optical element, that focuses the laser light Li passing through the lens 43*a* in the irradiation region IR in the lateral direction thereof. This exemplary embodiment requires no lens for causing the laser light Li to diverge in the arrangement direction of the LD array 42. In this exemplary embodiment, the LD array 42 and the lens 43*a* are moved together, with the lens 43*c* held at a predetermined position.

Figure 11B:
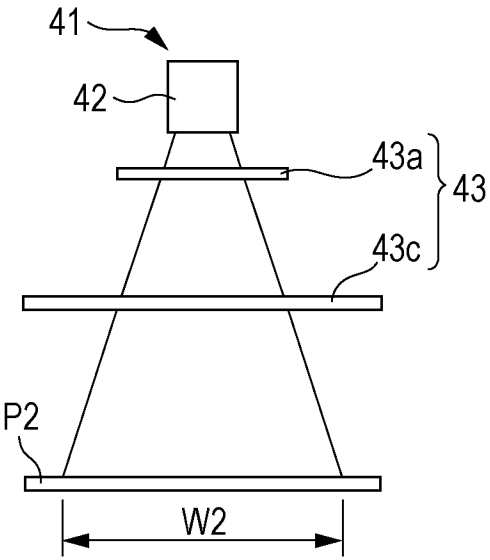
FIGS. 11A and 11B are schematic views showing different irradiation widths in the third exemplary embodiment.
Figure 11A:
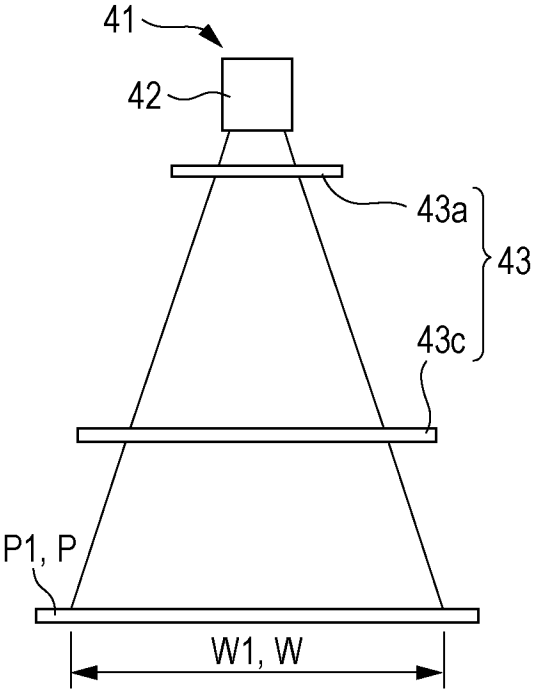

In this configuration, as the LD array 42 and the lens 43*a* are moved, the irradiation width W on the recording medium P changes as shown in FIGS. 11A and 11B. As shown in FIG. 11A, as the LD array 42 and the lens 43*a* are moved farther away from a recording medium P1, the laser light Li has a larger irradiation width W1 on the recording medium P1. As shown in FIG. 11B, as the LD array 42 and the lens 43*a* are moved closer to a recording medium P2, the laser light Li has a smaller irradiation width W2 on the recording medium P2.

In this exemplary embodiment, the emission intensity of the LD array 42 is also changed so that the emission intensity is lower in FIG. 11B than in FIG. 11A. This improves the uniformity of the irradiation intensity per unit area in the irradiation region IR and the life of the LD array 42 as compared to the case where the emission intensity is not changed. While the LD array 42 and the lens 43*a* are moved in this exemplary embodiment, the LD array 42 may be moved alone. In this case, a lens 43*a* long enough in the direction along the irradiation width W of the irradiation region IR may be used.

Fourth Exemplary Embodiment

Figure 12B:
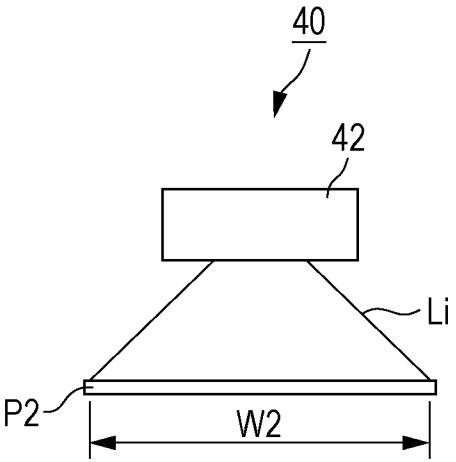
FIGS. 12A and 12B are schematic views showing different irradiation widths in a fourth exemplary embodiment.
Figure 12A:
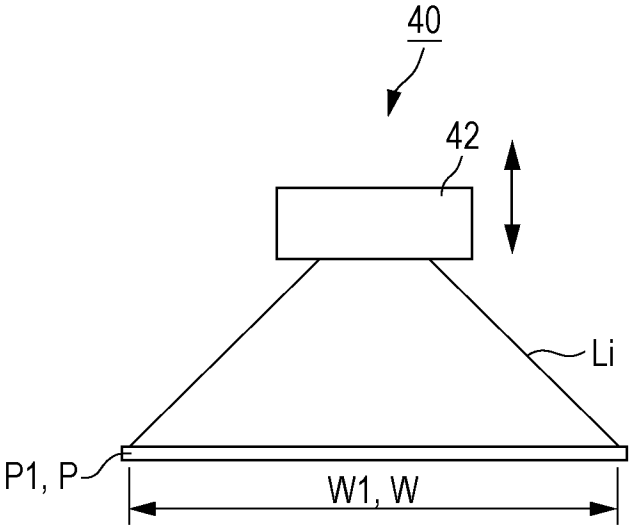

FIGS. 12A and 12B schematically show a fixing device 40 according to a fourth exemplary embodiment. Unlike the previous exemplary embodiments, the fixing device 40 according to this exemplary embodiment includes only the LD array 42 as an irradiation unit. The LD array 42 used in this exemplary embodiment includes LDs having the light emission property of emitting laser light Li diverging in the arrangement direction of the LD array 42. The LD array 42 is disposed such that the direction in which the laser light Li diverges at a larger angle is aligned to the direction of the irradiation width W of the irradiation region IR. Accordingly, the recording medium P is irradiated with the laser light Li with no optical element therebetween.

In this configuration, as the LD array 42 is moved, the irradiation width W on the recording medium P changes as shown in FIGS. 12A and 12B. As shown in FIG. 12A, as the LD array 42 is moved farther away from a recording medium P1, the laser light Li has a larger irradiation width W1 on the recording medium P1. As shown in FIG. 12B, as the LD array 42 is moved closer to a recording medium P2, the laser light Li has a smaller irradiation width W1 on the recording medium P2.

In this exemplary embodiment, the emission intensity of the LD array 42 is also changed so that the emission intensity is lower in FIG. 12B than in FIG. 12A. This improves the uniformity of the irradiation intensity per unit area in the irradiation region IR and the life of the LD array 42 as compared to the case where the emission intensity is not changed.

Fifth Exemplary Embodiment

Figure 13B:
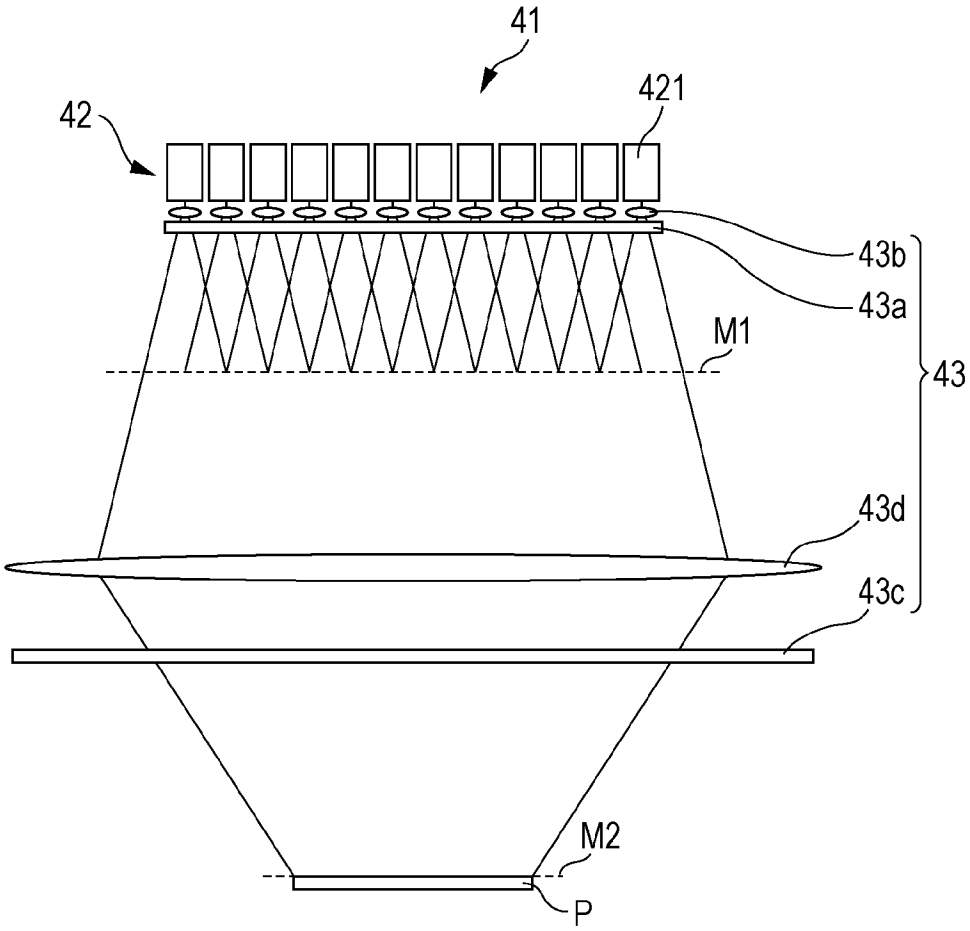
FIGS. 13A and 13B are schematic views showing a fixing device according to a fifth exemplary embodiment.
Figure 13A:
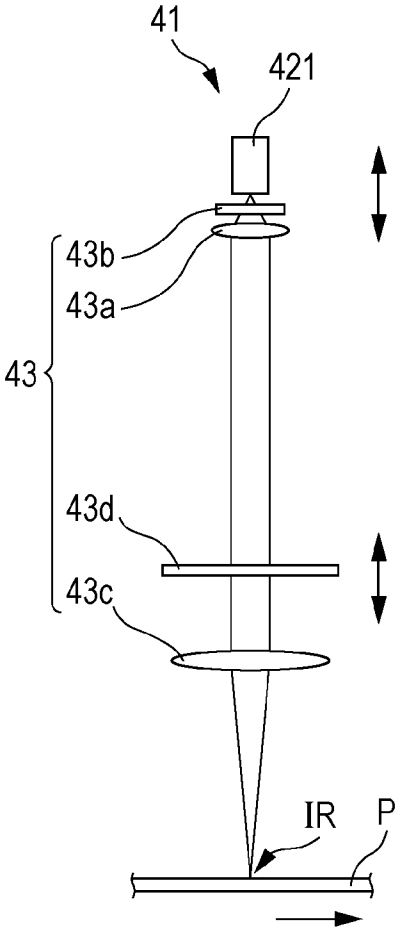

FIGS. 13A and 13B show a fixing device 40 according to a fifth exemplary embodiment. FIG. 13A is a schematic view of the fixing device 40 as viewed in the width direction of the recording medium P, which crosses the transportation direction thereof. FIG. 13B is a schematic view of the fixing device 40 as viewed in the transportation direction of the recording medium P. Unlike the fixing devices 40 according to the previous exemplary embodiments, the fixing device 40 according to this exemplary embodiment is movable at two positions in the irradiation device 41. The same elements as in the first exemplary embodiment are denoted by the same reference numerals, and a detailed description thereof is omitted here.

The optical elements 43 used in this exemplary embodiment include lenses 43*b*, as a diverging optical element, that cause the laser light Li emitted from the LD array 42 to diverge in the arrangement direction of the LD array 42; a lens 43*a*, as a condensing optical element, that condenses the laser light Li into substantially parallel light with the required beam width in a direction crossing the arrangement direction of the LD array 42; a lens 43*d*, as a focusing optical element, that focuses the laser light Li passing through the lens 43*a* at the magnification corresponding to the irradiation width W of the irradiation region IR; and a lens 43*c*, as a focusing optical element, that focuses the laser light Li passing through the lens 43*d* in the irradiation region IR in the lateral direction thereof. The lenses 43*b* used in this exemplary embodiment are separately provided for the individual LDs 421 of the LD array 42.

In this exemplary embodiment, the LD array 42 and the lenses 43*a* and 43*b* are combined together. The irradiation device 41 includes a first moving mechanism (not shown) that moves the LD array 42 and the lenses 43*a* and 43*b* together in the irradiation direction of the laser light Li and a second mechanism (not shown) that moves the lens 43*d* in the irradiation direction of the laser light Li, with the lens 43*c* held at a predetermined position.

In this configuration, the combination of the LD array 42 and the lenses 43*a* and 43*b* and the lens 43*d* are moved as follows.

Initially, the positions of the LDs 421 relative to each other and the positions of the lenses 43*a* and 43*b* are set so that the irradiation profile is uniform at the position indicated by reference line M1 in FIG. 13B.

Once a uniform profile is established along reference line M1, the profile in the irradiation region IR on the recording medium P (along reference line M2) remains stable even if either the combination of the LD array 42 and the lenses 43*a* and 43*b* or the lens 43*d* is moved. The profile there also remains stable even if both the combination of the LD array 42 and the lenses 43*a* and 43*b* and the lens 43*d* are moved to change the irradiation width W of the irradiation region IR.

Thus, the irradiation device 41, which is movable at multiple positions, allows the change in the irradiation width W in the irradiation region IR and the irradiation intensity to be functionally separated for easier adjustment than one movable at a single position, and also ensures a stable profile in the irradiation region IR. In addition, the emission intensity of the LD array 42 is changed, thus improving the uniformity of the irradiation intensity per unit area in the irradiation region IR and the life of the LD array 42 as compared to the case where the emission intensity is not changed. With this configuration, additionally, even if the LD array 42 is replaced, a uniform profile may be established along reference line M1 after the replacement to ensure a stable profile in the irradiation region IR. In this exemplary embodiment, the positions of the lenses 43*a* and 43*b* may be interchanged. In this case, at least the lens 43*b* may extend in the arrangement direction of the LD array 42.

Sixth Exemplary Embodiment

Figure 14:
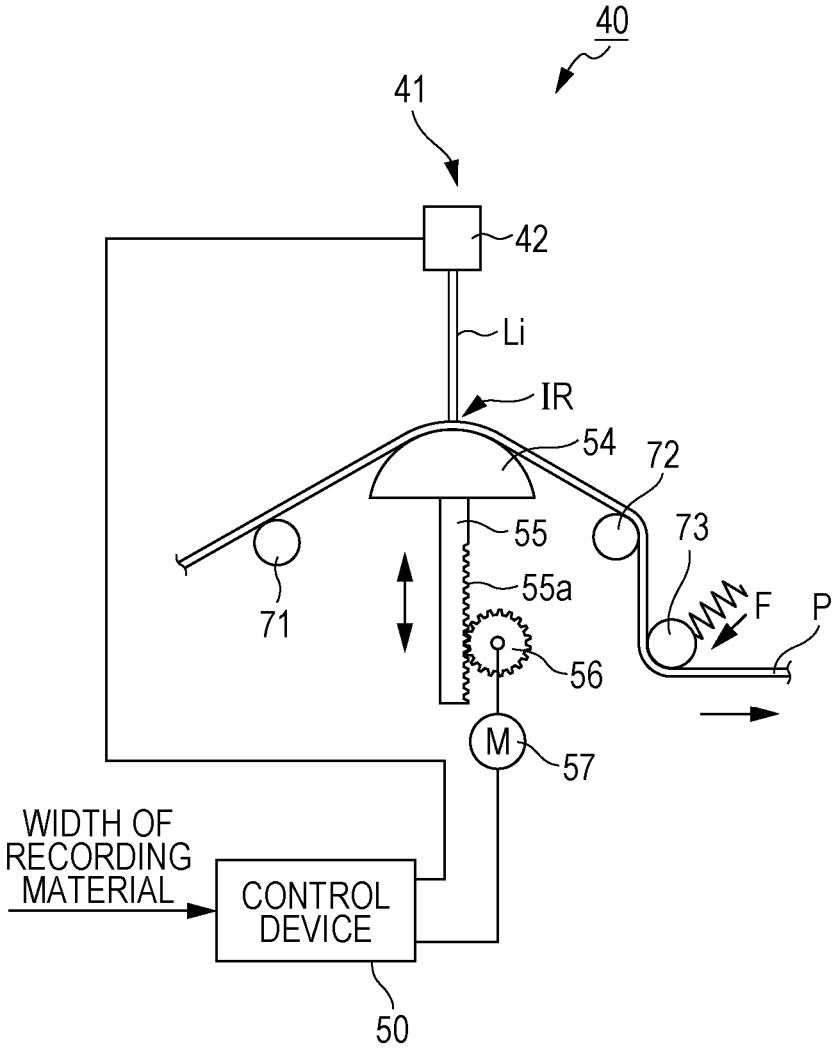
FIG. 14 is a schematic view showing a fixing device according to a sixth exemplary embodiment.

FIG. 14 shows a fixing device 40 according to a sixth exemplary embodiment. Unlike the fixing devices 40 according to the previous exemplary embodiments, the fixing device 40 according to this exemplary embodiment is configured such that the position of the recording medium P is variable.

The recording medium P is transported over tension rollers 71 and 72, as a transportation unit, disposed with the fixing device 40 therebetween. In addition, a tension-applying roller 73 for applying tension to the recording medium P being transported in the direction indicated by arrow F is disposed downstream of the tension roller 72 in the transportation direction of the recording medium P.

The fixing device 40 according to this exemplary embodiment includes an irradiation device 41 including an LD array 42 such as the one shown in FIGS. 12A and 12B and an opposing member 54 disposed opposite the LD array 42 with the recording medium P therebetween. The opposing member 54 contacts the back surface of the recording medium P. The opposing member 54 has a surface that is arc-shaped in the transportation direction of the recording medium P. The recording medium P is transported in contact with the opposing member 54.

The opposing member 54 has a support 55 for moving the opposing member 54 upward and downward in FIG. 14. The support 55 includes a rack 55*a* having teeth. A pinion 56 having teeth is disposed opposite the rack 55*a* and is connected to a motor 57. The motor 57 and the LD array 42 are controlled by the control device 50.

In this exemplary embodiment, the control device 50 drives the motor 57 to move the opposing member 54 upward and downward by performing control on the basis of the width of the recording medium P used, thus changing the irradiation width (not shown) in the irradiation region IR on the recording medium P. In addition, the emission intensity of the LD array 42 is changed depending on the change in irradiation width, thus improving the uniformity of the irradiation intensity per unit area in the irradiation region IR and the life of the LD array 42.

In this exemplary embodiment, the recording medium P remains stable in the irradiation region IR even after the movement of the opposing member 54 because the tension-applying roller 73 constantly applies tension to the recording medium P. While the recording medium P is moved relative to the irradiation device 41 in this exemplary embodiment, it should be understood that, for example, the irradiation device 41 may be simultaneously moved.

Seventh Exemplary Embodiment

Figure 15B:
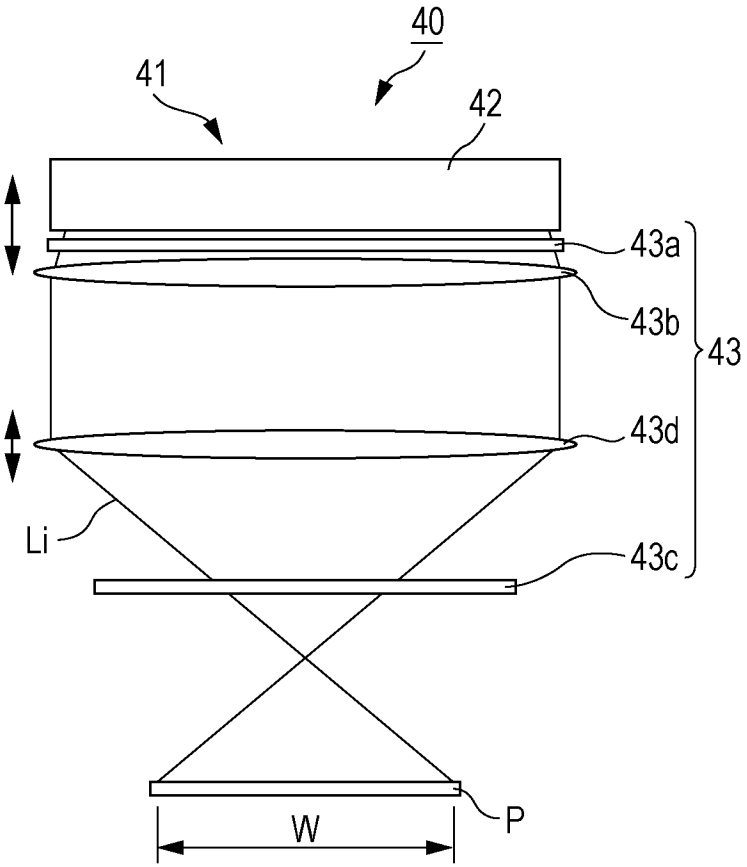
FIGS. 15A and 15B are schematic views showing a fixing device according to a seventh exemplary embodiment.
Figure 15A:
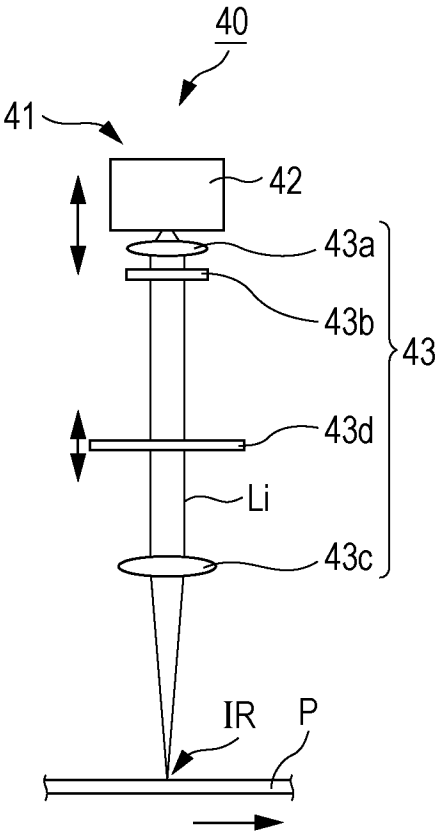

FIGS. 15A and 15B show a fixing device 40 according to a seventh exemplary embodiment. FIG. 15A is a schematic view of the fixing device 40 as viewed in the width direction of the recording medium P, which crosses the transportation direction thereof. FIG. 15B is a schematic view of the fixing device 40 as viewed in the transportation direction of the recording medium P. The fixing device 40 according to this exemplary embodiment has substantially the same structure as the fixing device 40 according to the second exemplary embodiment (see FIGS. 8A and 8B) but differs in that the fixing device 40 is movable at two positions in the irradiation device 41. The same elements as in the first exemplary embodiment are denoted by the same reference numerals, and a detailed description thereof is omitted here.

The optical elements 43 used in this exemplary embodiment are as follows. The lens 43*a* is a condensing optical element that condenses the laser light Li into substantially parallel light with the required beam width in a direction crossing the arrangement direction of the LD array 42. The lens 43*b* gathers the laser light Li with the required beam width in the arrangement direction of the LD array 42. The lens 43*d* is a focusing optical element that focuses the laser light Li passing through the lens 43*b* at the magnification corresponding to the irradiation width W of the irradiation region IR. The lens 43*c* is a focusing optical element that focuses the laser light Li passing through the lens 43*d* in the irradiation region IR in the lateral direction thereof.

In this exemplary embodiment, of the four lenses 43*a* to 43*d*, the lens 43*d* and the combination of the LD array 42 and the lenses 43*a* and 43*b* are movable upward and downward in FIGS. 15A and 15B by moving mechanisms (not shown).

Figure 16B:
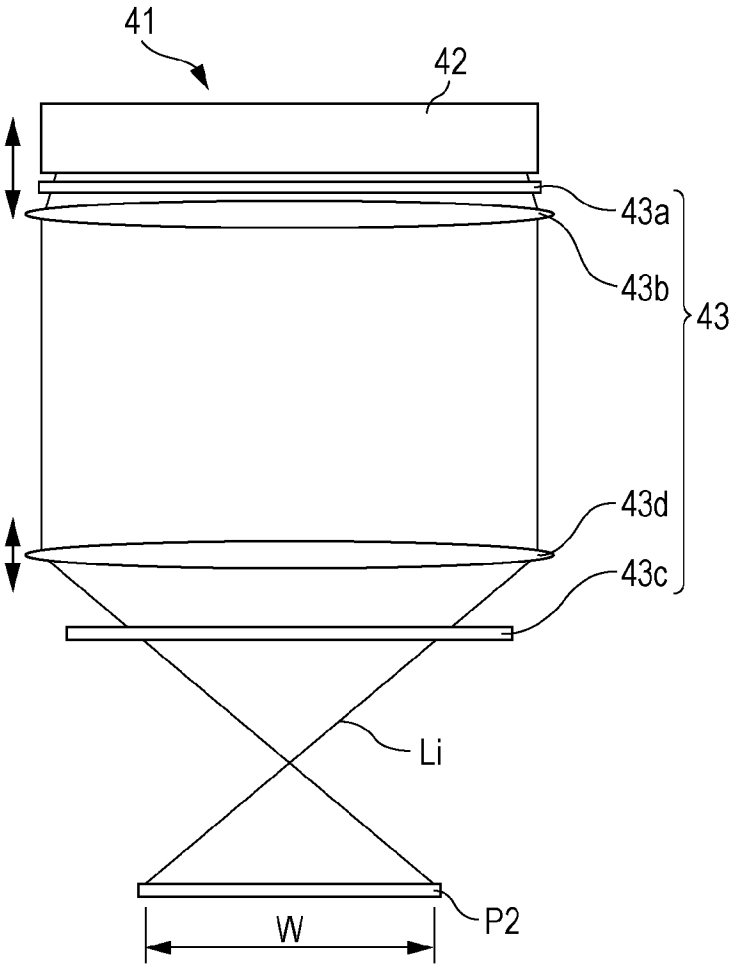
FIGS. 16A and 16B are schematic views showing different irradiation widths in the seventh exemplary embodiment.
Figure 16A:
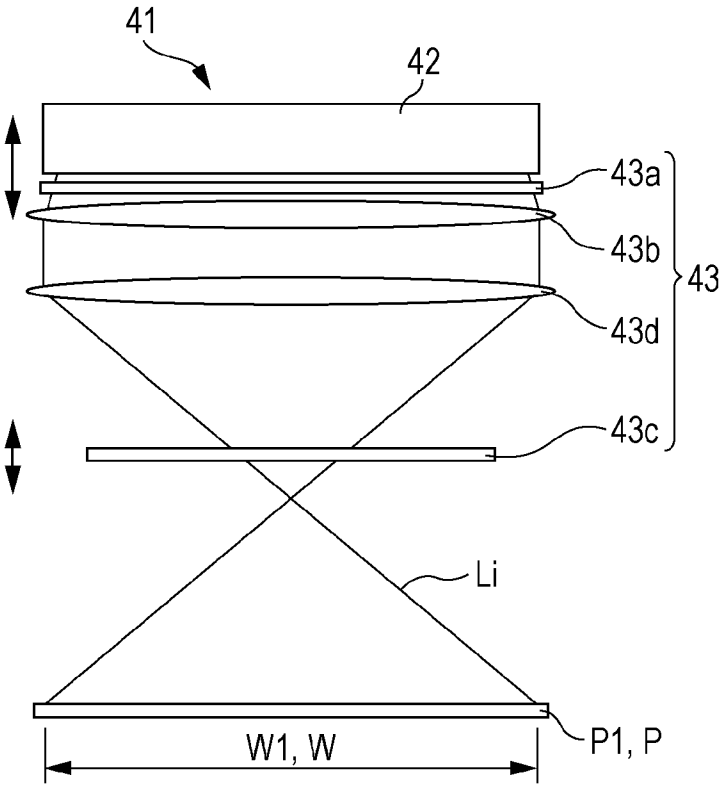

In this configuration, as the lens 43*d* is moved, the irradiation width W on the recording medium P changes as shown in FIGS. 16A and 16B. FIG. 16A shows the state where the lens 43*d* is moved farther away from a recording medium P1 (P), where the laser light Li has a larger irradiation width W1 on the recording medium P1. FIG. 16B shows the state where the lens 43*d* is moved closer to a narrower recording medium P2, where the laser light Li has a correspondingly smaller irradiation width W2 on the recording medium P2.

In this exemplary embodiment, the irradiation intensity on the recording medium P is changed by changing the position of the LD array 42, rather than by changing the emission intensity of the LD array 42. Specifically, the LD array 42 is located farther away from the recording medium P in FIG. 15B than in FIG. 15A. For the wider recording medium P1, as shown in FIG. 15A, the LD array 42 is moved closer to ensure sufficient irradiation intensity in the irradiation region IR. For the narrower recording medium P2, as shown in FIG. 15B, the LD array 42 is moved farther away to avoid excessive irradiation intensity.

In this exemplary embodiment, the effect of extending the life of the LD array 42 is not expected because the emission intensity of the LD array 42 is not changed depending on the irradiation width W, although uniform irradiation intensity in the irradiation region IR is ensured because the entire LD array 42 is turned on.

In this exemplary embodiment, the emission intensity of the LD array 42 may be changed depending on the movement thereof. This reduces the distance over which the LD array 42 is moved and also extends the life of the LD array 42 as compared to the case where the emission intensity is not changed.

Eighth Exemplary Embodiment

Figure 17:
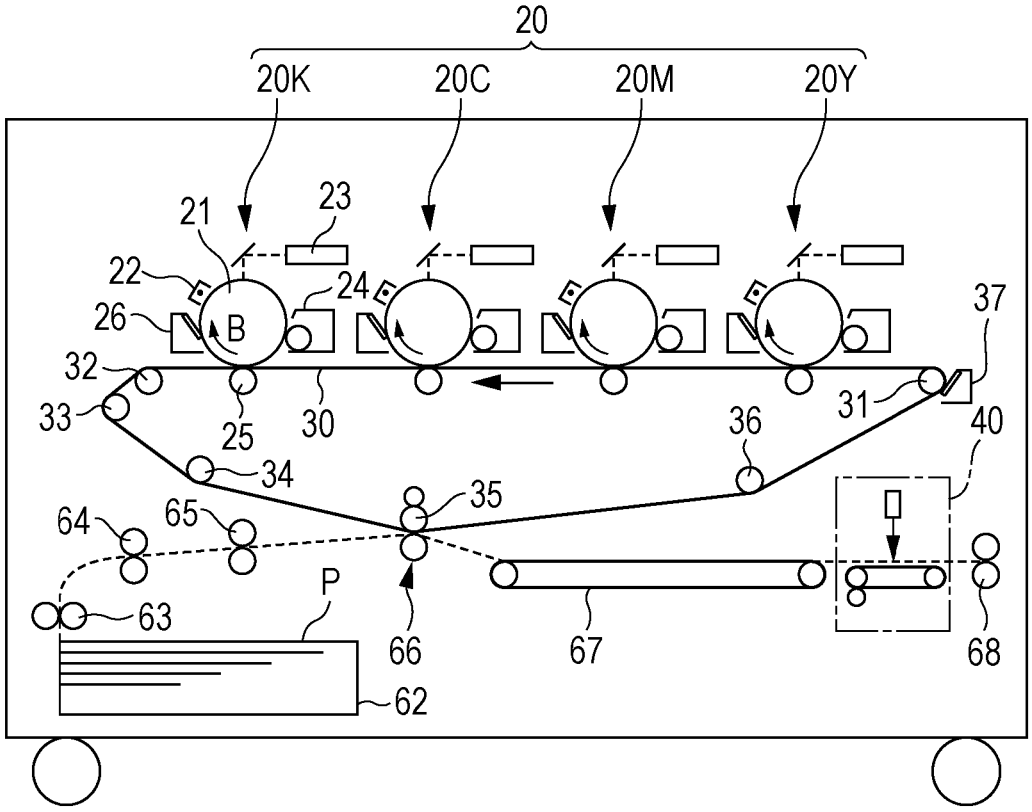
FIG. 17 is a schematic view showing the overall structure of an image-forming apparatus according to an eighth exemplary embodiment.

FIG. 17 schematically shows an image-forming apparatus including a fixing device 40 according to an eighth exemplary embodiment. Unlike the image-forming apparatus according to the first exemplary embodiment (see FIG. 2), the image-forming apparatus according to this exemplary embodiment is configured for use with flat recording media as the recording medium P. The same elements as in the first exemplary embodiment are denoted by the same reference numerals, and a detailed description thereof is omitted here.

In FIG. 17, the image-forming apparatus, which has, for example, an electrophotographic system, includes image-forming units 20 that form toner images of different colors on a recording medium (flat recording medium) P using, for example, four toners (specifically, a black image-forming unit 20K, a cyan image-forming unit 20C, a magenta image-forming unit 20M, and a yellow image-forming unit 20Y); a belt-like intermediate transfer member 30 that transports the toner images formed by the image-forming units 20 in a superimposed state; a simultaneous transfer device (second transfer device) 66 that simultaneously transfers the superimposed toner images from the intermediate transfer member 30 onto, for example, the recording medium P; and a fixing device 40 that fixes the unfixed toner image transferred onto the recording medium P by the second transfer device 66.

The image-forming units 20 have substantially the same structure except for the toner used and have the same structure as the image-forming units 20 according to the first exemplary embodiment (see FIG. 2). Hence, a detailed description thereof is omitted here.

The intermediate transfer member 30 used in this exemplary embodiment is stretched around and rotated by tension rollers 31 to 36. For example, the tension roller 31 is a drive roller, and the tension roller 34 is a tension-applying roller. The second transfer device 66 is disposed opposite the tension roller 35, which is used as a backup roller. A belt cleaning device 37 that removes residual toner from the intermediate transfer member 30 is disposed opposite the tension roller 31 with the intermediate transfer member 30 therebetween.

In the image-forming apparatus, additionally, a recording medium container 62 containing the recording medium P is disposed below the intermediate transfer member 30, and feed rollers 63 to 65, a transporting belt 67, and eject rollers 68 are disposed on the path along which the recording medium P fed from the recording medium container 62 is transported. The feed rollers 63 to 65 are arranged along the path from the recording medium container 62 to the second transfer device 66. The transporting belt 67 transports the recording medium P to the fixing device 40 after second transfer. The eject rollers 68 eject the recording medium P from the apparatus after fixing by the fixing device 40.

In this exemplary embodiment, the toner images formed by the image-forming units 20 are transferred from the photoreceptor drums 21, which rotate in the direction indicated by arrow B in FIG. 17, onto the intermediate transfer member 30 by the first transfer devices 25 such that they are superimposed on the intermediate transfer member 30. The recording medium P is fed from the recording medium container 62 to the second transfer position by the feed rollers 63 to 65. The toner images superimposed on the intermediate transfer member 30 are simultaneously transferred onto the recording medium P by the second transfer device 66. After the simultaneous transfer of the superimposed toner images by the second transfer device 66, the recording medium P is transported by the transporting belt 67 and is subjected to fixing by the fixing device 40. After fixing, the recording medium P is ejected from the image-forming apparatus by the eject rollers 68.

Figure 18:
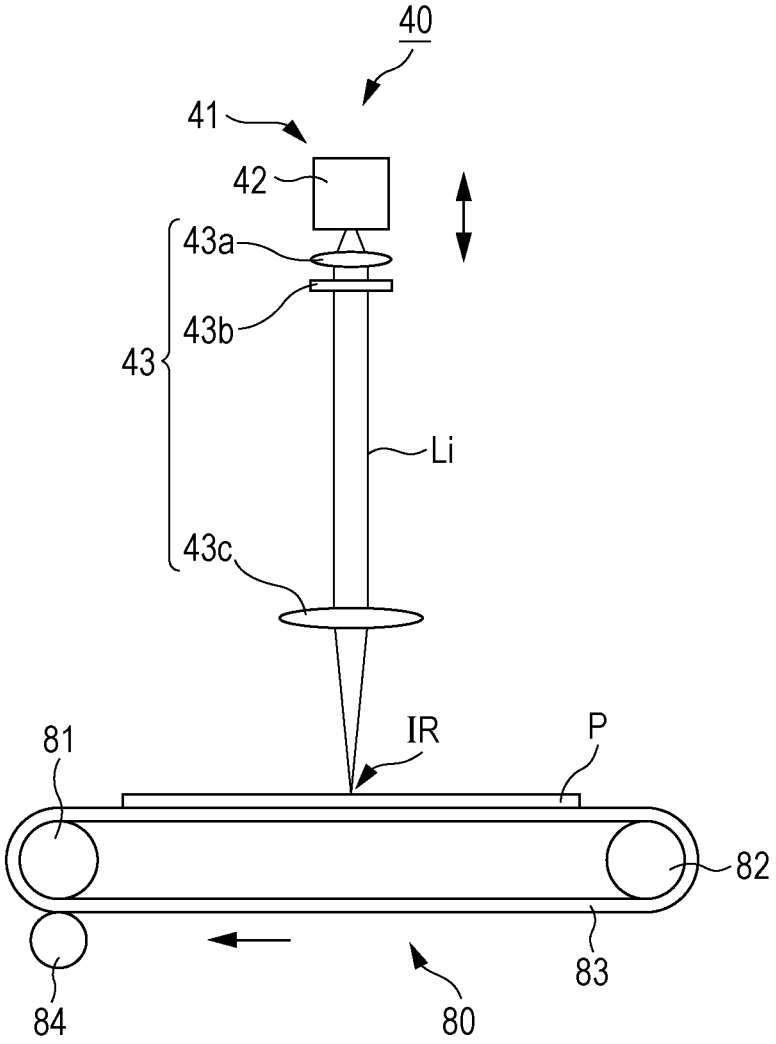
FIG. 18 is a schematic view showing a fixing device according to the eighth exemplary embodiment.

FIG. 18 schematically shows the fixing device 40 according to this exemplary embodiment. The irradiation device 41, as in the first exemplary embodiment (see, for example, FIG. 3), includes an LD array 42 and optical elements 43 (specifically, lenses 43*a* to 43*c*). Although omitted here, the fixing device 40 has a moving mechanism similar to that of the first exemplary embodiment. In this exemplary embodiment, an attraction transportation device 80 is provided that transports the recording medium P while holding the back surface thereof by, for example, electrostatic attraction.

The attraction transportation device 80 includes two rollers 81 and 82, a rotating belt 83 stretched around the two rollers 81 and 82, and a charging member 84 that charges the belt 83.

In this exemplary embodiment, when a recording medium P having an unfixed image reaches the fixing device 40, the recording medium P is electrostatically attracted by the belt 83 of the attraction transportation device 80, which is charged by the charging member 84, and is transported as the belt 83 rotates. The recording medium P transported by the rotation of the belt 83 is irradiated with the laser light Li emitted from the LD array 42 in the irradiation region IR so that the unfixed image is fixed. After fixing, the recording medium P is transported downstream as the belt 83 rotates. A releasing member for releasing the recording medium P from the attraction transportation device 80 after fixing may be provided to easily release the recording medium P from the belt 83.

In this exemplary embodiment, the LD array 42 and the lenses 43*a* and 43*b* are moved together depending on the width of the recording medium P, and the emission intensity of the LD array 42 is also changed. This ensures uniform emission intensity per unit area in the irradiation region IR for recording media P having different widths and also extends the life of the LD array 42.

In this exemplary embodiment, the attraction transportation device 80 stabilizes the flat recording medium P in the irradiation region IR to ensure uniform irradiation intensity of the laser light Li in the irradiation region IR. The belt 83 used for the attraction transportation device 80 may be a belt having a surface capable of reflecting the laser light Li passing through the recording medium P in the irradiation region IR toward the back surface of the recording medium P. For example, a belt containing a white pigment may be used.

While the charging member 84 used in this exemplary embodiment contacts the belt 83, a noncontact charging member such as a corona charger may be used to charge the belt 83 without contact. In addition, while the recording medium P is electrostatically attracted by the attraction transportation device 80 in this exemplary embodiment, it may be attracted by air suction from the backside of the belt 83. Furthermore, while the belt 83 is stretched around the two rollers 81 and 82 in this exemplary embodiment, for example, an opposing member (such as a roller) may be disposed opposite the irradiation region IR such that the recording medium P protrudes toward the LD array 42 in and around the irradiation region IR.

While the irradiation device 41 used in the first exemplary embodiment is used in this exemplary embodiment, it should be understood that the irradiation devices 41 of the other exemplary embodiments may be used instead.

Ninth Exemplary Embodiment

Figure 19A:
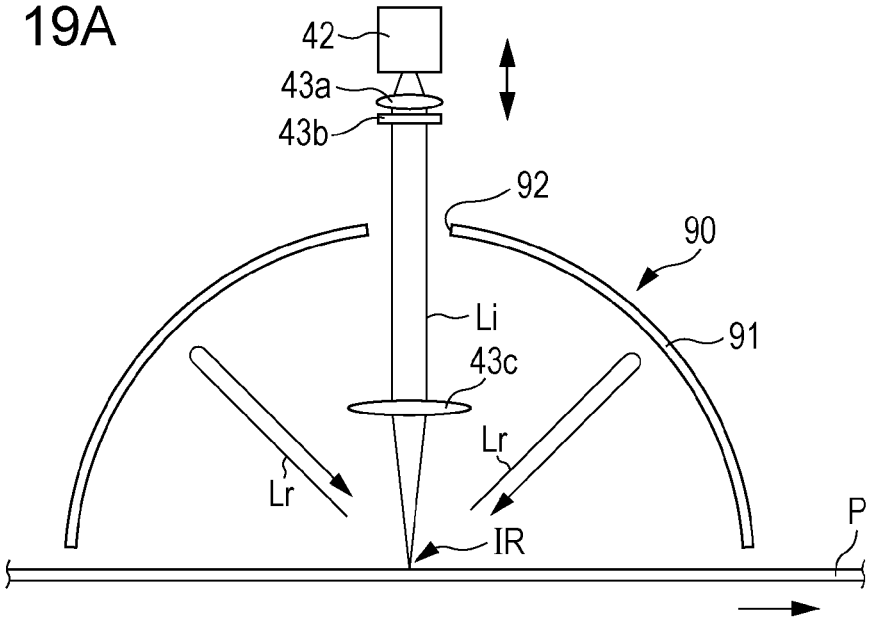
FIGS. 19A to 19C are schematic views showing a fixing device according to a ninth exemplary embodiment.
Figure 19B:
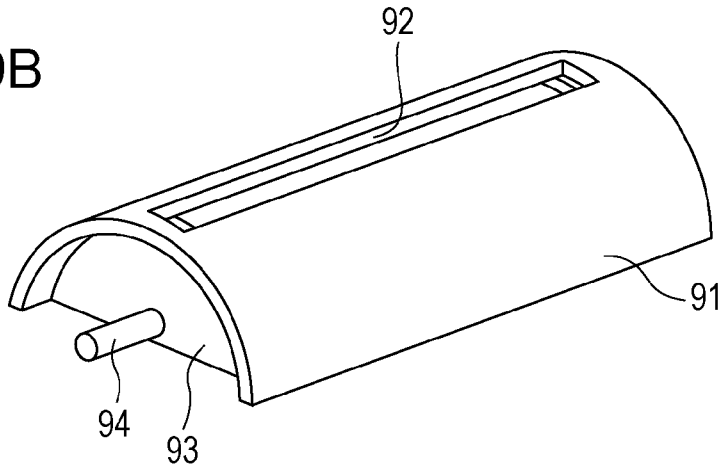
Figure 19C:
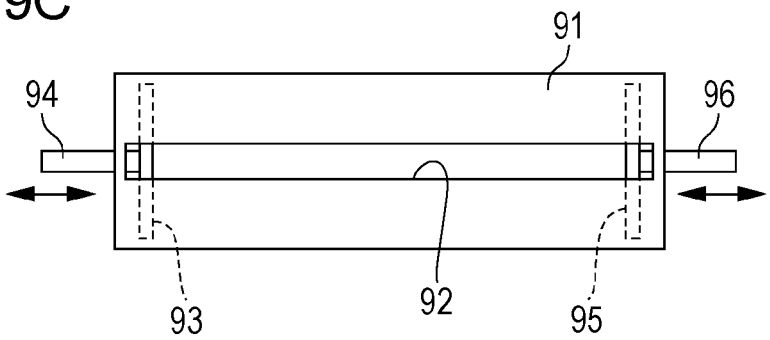

FIGS. 19A to 19C schematically show a fixing device 40 according to a ninth exemplary embodiment. FIG. 19A is a schematic view of the fixing device 40 as viewed in the width direction of the recording medium P, which crosses the transportation direction thereof. FIG. 19B is a perspective view of a reflective member 90, described later. FIG. 19C is a schematic view of the reflective member 90 as viewed from the LD array 42 side. Unlike the fixing devices 40 according to the previous exemplary embodiments, the fixing device 40 according to this exemplary embodiment includes the reflective member 90 in addition to the irradiation device 41.

The reflective member 90 used in this exemplary embodiment surrounds the region IR irradiated with the laser light Li emitted from the LD array 42. The reflective member 90 reflects reflected light Lr coming from the region IR irradiated with the laser light Li so as to irradiate the irradiation region IR again with the reflected light Lr. The reflective member 90 used in this exemplary embodiment has an opening 92 and includes a reflective portion 91 having a reflective surface curved so as to surround the irradiation region IR and two side reflective portions 93 and 95 arranged inside the reflective portion 91 in the longitudinal direction of the irradiation region IR and having inner reflective surfaces.

In this exemplary embodiment, for example, support shafts 94 and 96 having cylindrical worms are fixedly attached to the side reflective portions 93 and 95, respectively, such that worm wheels (not shown) mesh with the support shafts 94 and 96. Thus, the side reflective portions 93 and 95 are movable in the longitudinal direction of the irradiation region IR.

In this exemplary embodiment, the LD array 42 and the lenses 43*a* and 43*b* are moved together depending on the width of the recording medium P, and the side reflective portions 93 and 95 of the reflective member 90 are also moved depending on the width of the recording medium P. Accordingly, even if the irradiation width W of the irradiation region IR is changed, the side reflective portions 93 and 95 of the reflective member 90 ensure a reflective region of the corresponding width, thus allowing the reflected light Lr coming from the irradiation region IR to be more effectively utilized.

While the side reflective portions 93 and 95 are moved using cylindrical worms and worm wheels in this exemplary embodiment, the mechanism used for moving the side reflective portions 93 and 95 is not limited thereto, and a known mechanism may be selected.

It should be understood that the recording medium P used in this exemplary embodiment may be either continuous paper or flat paper.

While the side reflective portions 93 and 95 of the reflective member 90 are moved depending on the width of the recording medium P in this exemplary embodiment, they may be fixed at the maximum width of the recording medium P used. In this case, the availability of the laser light Li is higher than without the reflective member 90 because the reflective portion 91 irradiates the irradiation region IR again with the reflected light Lr.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

an irradiation unit disposed opposite a recording medium having an unfixed image of an image-forming material capable of being thermally fixed, the irradiation unit including a plurality of laser light sources arranged in a direction crossing a movement direction of the recording medium and capable of emitting laser light with variable emission intensity, the irradiation unit irradiating a surface of the recording medium with the laser light emitted from the plurality of laser light sources in a substantially elongated irradiation region extending at a corresponding position in the arrangement direction of the plurality of laser light sources;

an irradiation-width changing unit that changes the irradiation width of the irradiation region in a longitudinal direction thereof, with all the plurality of laser light sources of the irradiation unit turned on; and an irradiation-intensity adjusting unit that adjusts the irradiation intensity in the irradiation region having the irradiation width thereof changed by the irradiation-width changing unit to maintain a predetermined required irradiation intensity.

2. The fixing device according to claim 1, wherein the irradiation-intensity adjusting unit adjusts the emission intensity of the plurality of laser light sources.

3. The fixing device according to claim 2, wherein the irradiation-intensity adjusting unit continuously or discontinuously changes the emission intensity of the plurality of laser light sources to a lower level if the irradiation-width changing unit changes the irradiation width of the irradiation region to a smaller width and continuously or discontinuously changes the emission intensity of the plurality of laser light sources to a higher level if the irradiation-width changing unit changes the irradiation width of the irradiation region to a larger width.

4. The fixing device according to claim 1, wherein the irradiation unit further includes an optical system that guides the laser light to the irradiation region, the optical system including a focusing optical element fixedly disposed opposite the irradiation region to focus the laser light emitted from the plurality of laser light sources in the irradiation region, the irradiation-width changing unit moving at least part of the optical system other than the focusing optical element in the irradiation direction of the laser light.

5. The fixing device according to claim 2, wherein the irradiation unit further includes an optical system that guides the laser light to the irradiation region, the optical system including a focusing optical element fixedly disposed opposite the irradiation region to focus the laser light emitted from the plurality of laser light sources in the irradiation region, the irradiation-width changing unit moving at least part of the optical system other than the focusing optical element in the irradiation direction of the laser light.

6. The fixing device according to claim 3, wherein the irradiation unit further includes an optical system that guides the laser light to the irradiation region, the optical system including a focusing optical element fixedly disposed opposite the irradiation region to focus the laser light emitted from the plurality of laser light sources in the irradiation region, the irradiation-width changing unit moving at least part of the optical system other than the focusing optical element in the irradiation direction of the laser light.

7. The fixing device according to claim 1, wherein the irradiation unit further includes an optical system that guides the laser light to the irradiation region, the optical system including a diverging optical element that causes the laser light emitted from the plurality of laser light sources to diverge in the arrangement direction of the plurality of laser light sources, the irradiation-width changing unit moving the plurality of laser light sources and the diverging optical element in the irradiation direction of the laser light.

8. The fixing device according to claim 1, wherein the irradiation unit further includes an optical system that guides the laser light to the irradiation region, the optical system including a plurality of optical elements arranged in the irradiation direction of the laser light, the irradiation-width changing unit including a first moving mechanism that moves, of the plurality of optical elements, an optical element located closer to the plurality of laser light sources in the irradiation direction of the laser light and a second moving mechanism that moves, of the plurality of optical elements, an optical element different from the optical element moved by the first moving mechanism in the irradiation direction of the laser light.

9. The fixing device according to claim 1, wherein the plurality of laser light sources have the light emission property of emitting laser light diverging in the arrangement direction of the plurality of laser light sources, the irradiation-width changing unit moving at least the plurality of laser light sources in the irradiation direction of the laser light.

10. The fixing device according to claim 2, wherein the plurality of laser light sources have the light emission property of emitting laser light diverging in the arrangement direction of the plurality of laser light sources, the irradiation-width changing unit moving at least the plurality of laser light sources in the irradiation direction of the laser light.

11. The fixing device according to claim 3, wherein the plurality of laser light sources have the light emission property of emitting laser light diverging in the arrangement direction of the plurality of laser light sources, the irradiation-width changing unit moving at least the plurality of laser light sources in the irradiation direction of the laser light.

12. The fixing device according to claim 1, further comprising an opposing member disposed opposite a position corresponding to at least the irradiation region on a back surface of the recording medium, the opposing member moving the position in the irradiation direction of the laser light, the irradiation-width changing unit changing the irradiation width of the irradiation region by moving the opposing member.

13. The fixing device according to claim 2, further comprising an opposing member disposed opposite a position corresponding to at least the irradiation region on a back surface of the recording medium, the opposing member moving the position in the irradiation direction of the laser light, the irradiation-width changing unit changing the irradiation width of the irradiation region by moving the opposing member.

14. The fixing device according to claim 3, further comprising an opposing member disposed opposite a position corresponding to at least the irradiation region on a back surface of the recording medium, the opposing member moving the position in the irradiation direction of the laser light, the irradiation-width changing unit changing the irradiation width of the irradiation region by moving the opposing member.

15. The fixing device according to claim 1, wherein the irradiation-intensity adjusting unit adjusts the distance between the plurality of laser light sources and the irradiation region.

16. The fixing device according to claim 1, further comprising:

a recognition unit that recognizes at least one of the width of the recording medium and the width of an image-forming region on the recording medium in a width direction crossing the movement direction of the recording medium; and a controller that controls the irradiation-width changing unit and the irradiation-intensity adjusting unit on the basis of the result of recognition by the recognition unit to maintain the required irradiation intensity in an irradiation region corresponding to the width of the recording medium or the image-forming region.

17. The fixing device according to claim 1, wherein all or groups of the plurality of laser light sources are series-connected such that a current supplied to the plurality of laser light sources is at or below a predetermined level.

18. An image-forming apparatus comprising:

a transportation unit that transports a recording medium;

an image-forming unit that forms an image on the recording medium transported by the transportation unit; and the fixing device according to claim 1, the fixing device fixing the image formed on the recording medium by the image-forming unit.

* * * * *